US005640807A

United States Patent [19]

Shigematsu et al.

[11] Patent Number: 5,640,807

[45] Date of Patent: Jun. 24, 1997

[54] POWERED VEHICLE DOOR CLOSING SYSTEM

[75] Inventors: Kouichi Shigematsu, Yokohama; Osamu Kawanobe, Isehara; Jun Yamagishi, Yokohama, all of Japan

[73] Assignee: Ohi Seisakusho Co., Ltd., Yokohama, Japan

[21] Appl. No.: 570,688

[22] Filed: Dec. 11, 1995

[30] Foreign Application Priority Data

Dec. 12, 1994 [JP] Japan ..... 6-307638

[51] Int. Cl.[6] ..... E05F 7/00; E05F 15/00

[52] U.S. Cl. ..... 49/449; 49/280; 292/DIG. 23

[58] Field of Search ..... 49/280, 360, 449, 49/394; 292/DIG. 23, 216, 341.16

[56] References Cited

U.S. PATENT DOCUMENTS

| | | | |
|---|---|---|---|
| 4,775,178 | 10/1988 | Boyko | 49/394 X |
| 4,968,074 | 11/1990 | Yamagishi et al. | 292/DIG. 23 X |
| 4,984,385 | 1/1991 | DeLand | 49/280 |
| 5,083,397 | 1/1992 | Koura | 49/280 X |
| 5,155,937 | 10/1992 | Yamagishi | 49/280 |
| 5,189,839 | 3/1993 | DeLand et al. | 49/360 |
| 5,203,112 | 4/1993 | Yamagishi et al. | 49/280 |

FOREIGN PATENT DOCUMENTS 1-105886 4/1989 Japan .

*Primary Examiner*—Philip C. Kannan
*Attorney, Agent, or Firm*—Foley & Lardner

[57] ABSTRACT

A powered vehicle door closing system for producing an auto-closing action to automatically move a latch member from a half-latched position to a fully-latched position comprises a reversible motor mechanically linked through a linkage to the latch member, for powering a final, low-displacement/high-force movement of a vehicle door, and a controller for controlling the motor. The controller includes a full-latch confirmation section for confirming that the latch member is maintained at its fully-latched position, and a motor-drive limiting section for limiting re-activation of the motor so as to avoid ineffective auto-closing action of the system when the full-latch confirmation section decides that the latch member has already been shifted to and maintained at the fully-latched position.

10 Claims, 23 Drawing Sheets

POWERED VEHICLE DOOR CLOSING SYSTEM

BACKGROUND OF THE INVENTION

1. Field of the Invention

The present invention relates to a powered vehicle door closing system and specifically to a powered vehicle door closing system suitable for an automotive vehicle such as a van with a sliding door moveable between open and closed positions relative to a vehicle body opening, and more specifically to a system which is capable of forcibly and automatically moving a latch member employed in a lock unit from a half-latched position (a nearly-closed position of the sliding door) to a fully-latched position (a fully-closed position of the sliding door) by powering the final, low-displacement/high-force movement of the sliding door.

2. Description of the Prior Art

Recently, there have been proposed and developed various powered vehicle door closing systems which can automatically move a latch member from a half-latched position to a fully-latched position. One such powered vehicle door closing system has been disclosed in Japanese Patent Provisional Publication (Tokkai Heisei) No. 1-105886. The powered door closing system disclosed in the Japanese Patent Provisional Publication No. 1-105886 is applied to a door lock for an automobile sliding door. The prior art door closing system has three switches, namely a first switch for detection of a half-latched state of the latch member, a second switch for detection of a fully-latched state of the latch member, and a third member for detection of a stand-by position of a moveable drive lever (a portion of a force-transmitting linkage) by way of which the latch member can be shifted from the half-latched position to the fully-latched position. The first switch consists of a pair of electrical contacts, one being a stationary electrical contact provided in the vehicle body and the other being a spring-loaded, plunger-type electrical contact provided in the door for contact with the stationary contact upon shift to the half-latched position of the latch member via the manual door operation. The first switch is responsive to the movement of the sliding door in such a manner as to rotate the drive lever away from its stand-by position by way of normal rotation (positive rotation) of a drive motor such as a reversible electric motor when the sliding door reaches the half-latched position of the latch member, and as a result the latch member is forcibly moved to its fully-latched position. The second switch is responsive to the movement of the latch member in such a manner as to rotate the drive lever toward the stand-by position by way of reverse-rotation (negative rotation) of the drive motor when the latch member reaches the fully-latched position. The third switch is responsive to the movement of the drive lever in such a manner as to stop the drive motor and consequently to maintain the drive lever at the stand-by position immediately when the drive lever reaches the stand-by position. Each of the second and third switches consists of an ordinary limit switch. The conventional powered door closing system also includes a motor-drive controlling circuit disposed in the sliding door for properly controlling the drive motor depending upon detection results of the respective switches. In the Japanese Patent Provisional Publication No. 1-105886, the controlling circuit includes a plurality of relays to establish an electric power supply circuit to the drive motor in cooperation with two pairs of electric contacts. A basic structure of each electric contact pair is similar to the above-noted first switch. That is, the respective contact pair consists of a stationary electrical contact provided in the vehicle body and a spring-loaded plunger-type electrical contact provided onto the sliding door. The stationary contact of a first pair of the two electric contact pairs is connected to a positive terminal such as voltage +12, whereas the stationary contact of a second pair of the two electric contact pairs is connected to ground. The opposing electric contacts of the respective electric contact pair are brought into electric-contact with each other to establish the power supply circuit for the drive motor just before the half-latched position is reached during the manual door closing operation. In such a conventional powered vehicle door closing system, there is a possibility that the associated electrical contacts are accidentally temporarily disengaged from each other owing to vibrations of the vehicle. If the temporary disengagement occurs, the controlling circuit is usually reset. Thereafter, in the event that the associated contacts are engaged with each other once again, the drive motor will be driven again even when the latch member has already reached the fully-latched position. This produces a wasteful electric-power consumption. Additionally, when closing the sliding door rapidly with great momentum, the latch member may be often shifted to the fully-latched position owing to inertia of the door, without requiring any auto-closing action of the door closing system. Even when the latch member has already been shifted to the fully-latched position, the drive motor will be ineffectively driven with a response-time delay of the actual motor driving action with respect to a timing of detection of the half-latched position. The operator may feel uncomfortable.

SUMMARY OF THE INVENTION

Accordingly, it is an object of the invention to provide an improved powered vehicle door closing system which avoids the foregoing disadvantages of the prior art. That is, a main object of the invention is to provide a powered vehicle door closing system which prevents wasteful power consumption and uncomfortable feel of the operator, by eliminating ineffective auto-closing action.

In order to accomplish the aforementioned and other objects of the invention, a powered vehicle door closing system for producing an auto-closing action to automatically move a latch member from a half-latched position to a fully-latched position, the system comprises a reversible motor mechanically linked through a linkage to the latch member, for powering a final, low-displacement/high-force movement of a vehicle door, and a control means for controlling the reversible motor so that the reversible motor is driven in its normal-rotation direction for rotational movement of the latch member toward the fully-latched position when the half-latched position is reached during manual door closing operation, and so that the reversible motor is driven in its reverse-rotation direction for movement of the linkage toward its neutral position when the fully-latched position is reached during auto-closing action, and so that the reversible motor is stopped when the linkage reaches the neutral position. The control means includes confirmation means for confirming that the latch member is maintained at the fully-latched position, and limit means for limiting re-activation of the reversible motor when the confirmation means decides that the latch member has already been shifted to and maintained at the fully-latched position. The confirmation means may comprise a partly-opened position detection switch for detecting a predetermined partly-opened position of the vehicle door via which partly-opened position the latch member reaches the half-latched position during door closing, a half-latch detection switch for detecting that the latch member reaches the half-latched position, means for measuring a time interval from a time when the partly-opened position detection switch detects that the predetermined partly-opened position is reached to a time when the half-latch detection switch detects that the half-latched position is reached, and means for deciding that the latch member has already been shifted to and maintained at the fully-latched position when the time interval is within a predetermined short time interval. The partly-opened position detection switch may comprise a pair of electric power-feeding portions for establishing a power-supply circuit for the control means when the vehicle door reaches the predetermined partly-opened position.

Alternatively, the confirmation means comprises a partly-opened position detection switch for detecting a predetermined partly-opened position of the vehicle door via which partly-opened position the latch member reaches the half-latched position during door closing, a half-latch detection switch for detecting that the latch member reaches the half-latched position, first measurement means for measuring a first short elapsed time from a time when the partly-opened position detection switch detects that the predetermined partly-opened position is reached, second measurement means for measuring a second short elapsed time from a time when the partly-opened position detection switch detects that the predetermined partly-opened position is reached, and means for deciding that the latch member has already been shifted to and maintained at the fully-latched position when the half-latch detection switch is switched ON within a time interval defined between the first and second short elapsed times. The confirmation means may comprise a pair of electric power-feeding portions which establish a power-supply circuit for the control means when the vehicle door reaches the predetermined partly-opened position, means for monitoring a return-to-neutral action of the linkage to the neutral position and for setting a flag representing that the neutral position is reached after the power-supply circuit has been established, and means for deciding that the latch member has already been shifted to and maintained at the fully-latched position when the flag is set.

The confirmation means may comprise means for detecting a load applied to the reversible motor when the latch member moves from the half-latched position to the fully-latched position, and decision means for deciding that the latch member has already been shifted to and maintained at the fully-latched position when the load is less than a predetermined threshold. In more detail, the means for detecting the load may comprise a current detection means for detecting a drive current flowing across the reversible motor, and the decision means for deciding that the latch member has already been shifted to and maintained at the fully-latched position when the drive current is less than a predetermined comparison current value. The system may further comprise means for calculating the comparison current value by adding a preset margin to a mean value of the drive current data sampled for a predetermined time period from a time when a predetermined time period for stabilization of the drive current has elapsed. The confirmation means may comprise a partly-opened position detection switch for detecting a predetermined partly-opened position of the vehicle door via which partly-opened position the latch member reaches the half-latched position during door closing, a half-latch detection switch for detecting that the latch member reaches the half-latched position, means for measuring a time interval from a time when the partly-opened position detection switch detects that the predetermined partly-opened position is reached to a time when the half-latch detection switch detects that the half-latched position is reached, and means for setting the preset margin depending upon the time interval. It is preferable that the preset margin is reduced in accordance with a decrease in the time interval, so as to more precisely decide a quick door closing action with great momentum.

DESCRIPTION OF THE PREFERRED EMBODIMENTS

First embodiment

Figure 1:
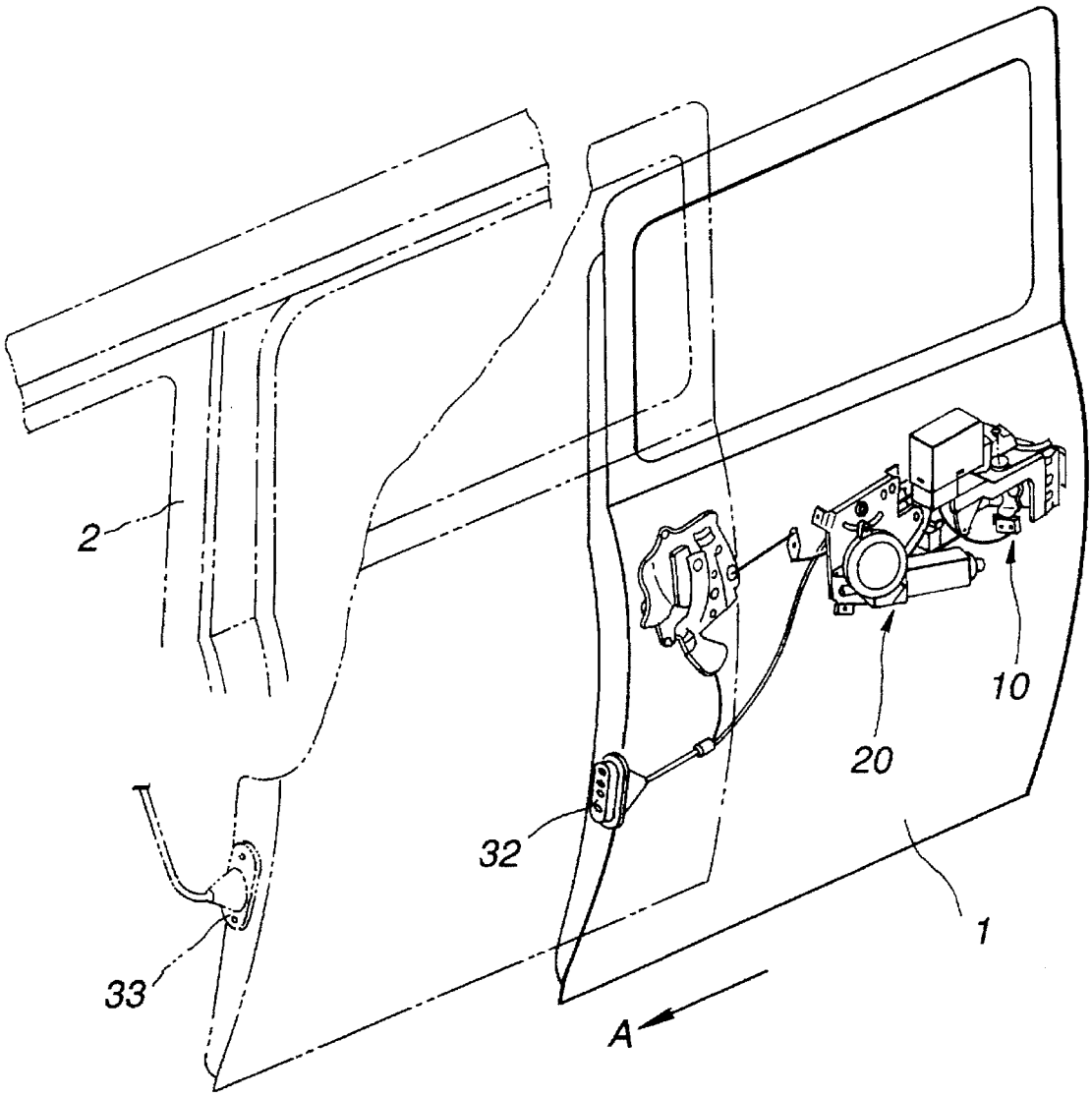
FIG. 1 is a perspective view illustrating an automobile sliding door employing a powered vehicle door closing system according to the invention.
Figure 2:
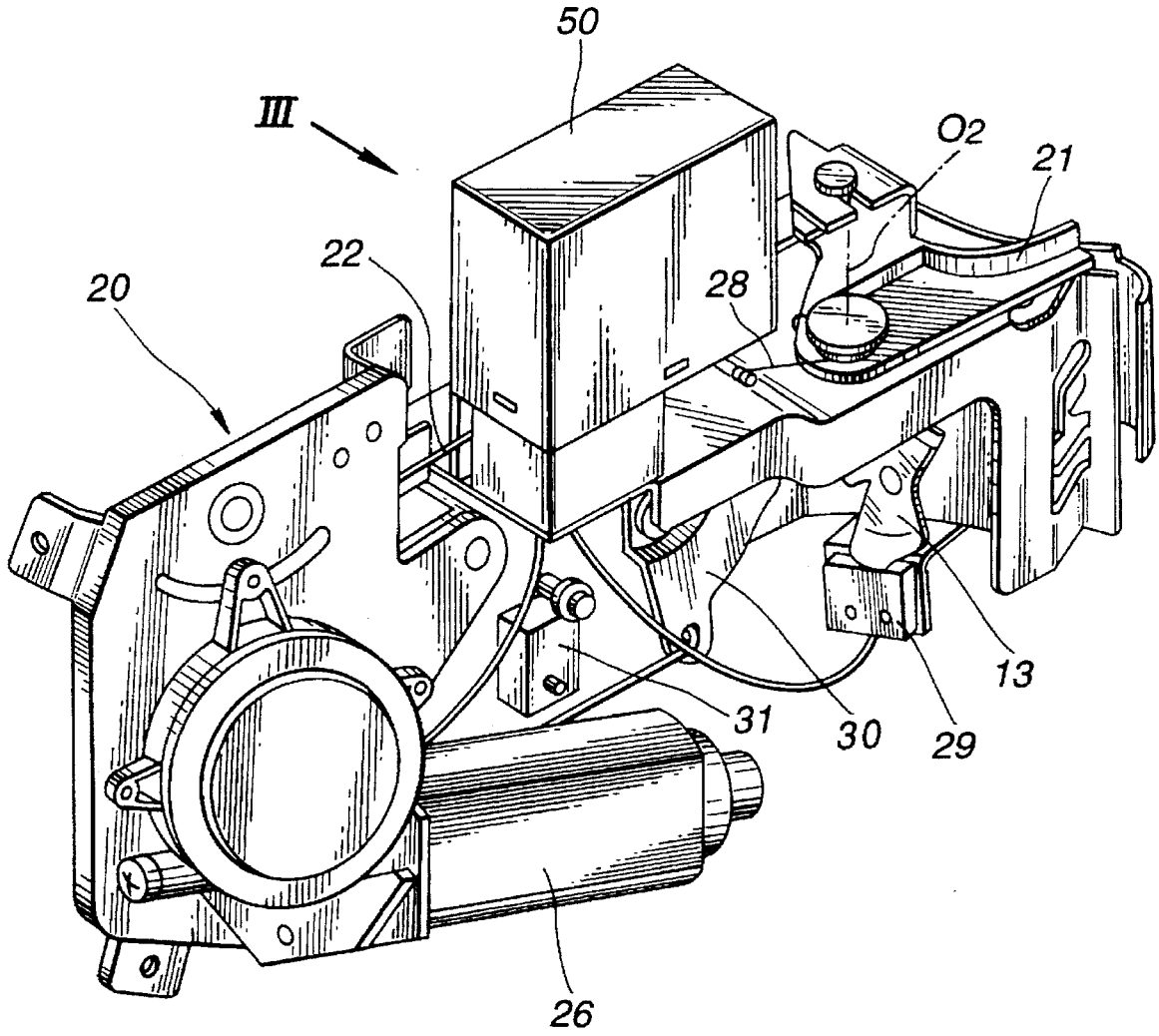
FIG. 2 is a perspective view illustrating a first embodiment of the powered vehicle door closing system made according to the invention.
Figure 3:
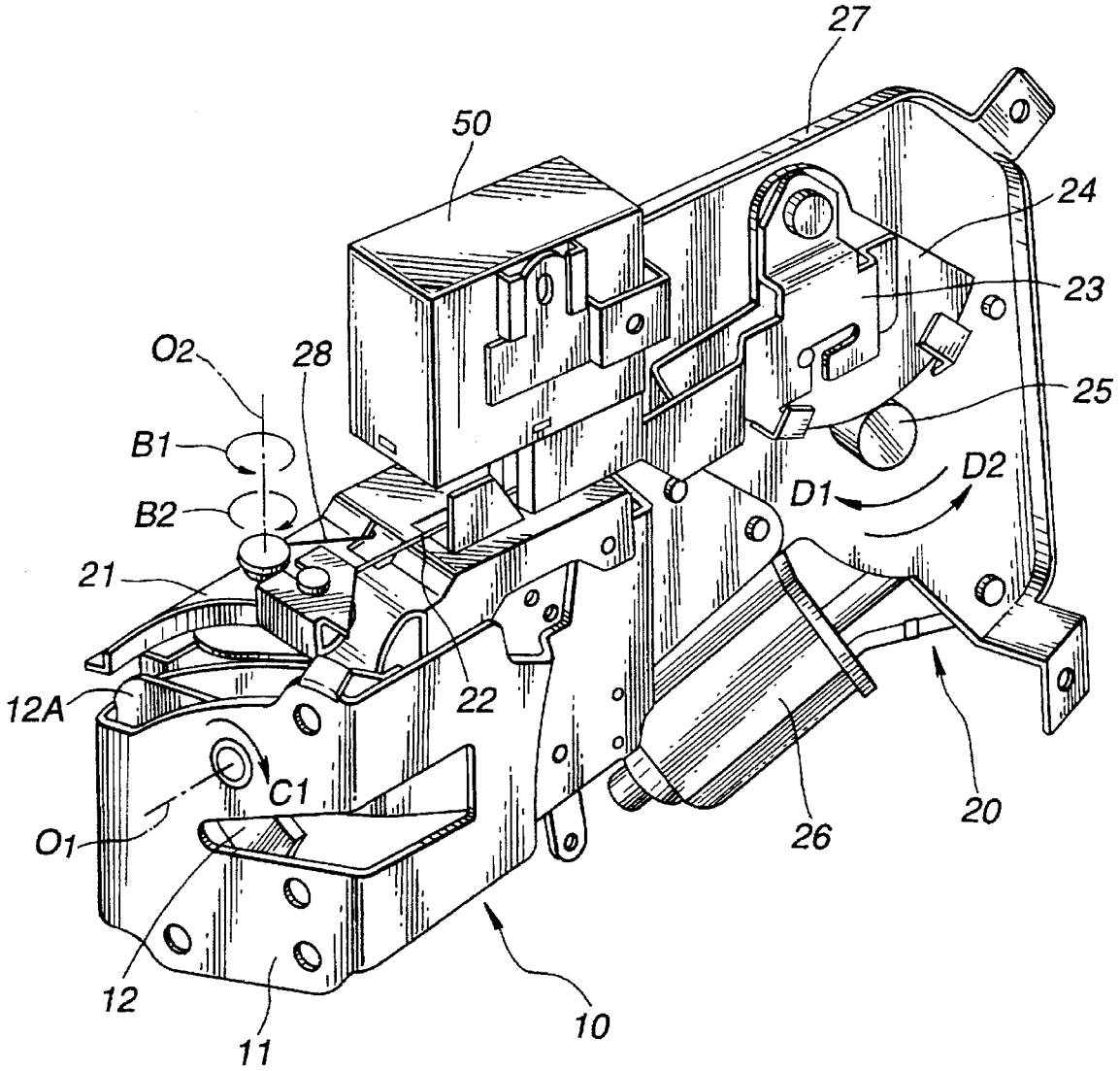
FIG. 3 is a perspective view taken in the direction of the arrow III of FIG. 2.

Referring now to the drawings, particularly to FIGS. 1 to 3, the powered vehicle door closing system of the invention is exemplified in case of a left-hand side sliding door 1 of an automotive vehicle. As seen in FIG. 1, the powered vehicle door closing system of the invention includes a door lock device 10 and a door closing device 20. As seen in FIGS. 2 and 3, the latter is often connected integrally to the door lock device 10 as a unit. As clearly seen in FIG. 3, a latch member 12 is rotatably supported on a base 11 of the door lock device 10 so that the latch member 12 is rotatable about the axial line $O_1$ and engageable with a stationary striker pin (not shown) attached to the vehicle body 2. When the sliding door 1 is moved in the door closing direction as indicated by the arrow A of FIG. 1 and then the latch member 12 reaches its fully-latched position, in which the striker pin and the latch member 12 are completely engaged to each other, a locking plate (not shown) completely locks the latch member 12 at the fully-latched position in a conventional manner, with the result that the sliding door 1 is held at the fully-closed position. As is generally known, the locking plate is mechanically linked to a locking-plate release lever (not shown), by way of which the locking state of the latch member 12 can be released or unlocked. The door closing device 20 is equipped with a close lever 21 which is rotatable about the axial line $O_2$. When the close lever 21 is rotated in the counterclockwise direction indicated by the arrow B1 (viewing FIG. 3) from the stand-by position (the neutral position as indicated in FIG. 3), the close lever 21 is brought into contact with the projected portion 12A of the latch member 12. With further counterclockwise rotation of the close lever 21, the latch member 12 is rotated in the direction indicated by the arrow C1. As a result of this, the latch member 12 reaches the half-latched position at which the latch member 12 begins to engage with the striker pin, and further is urged to the fully-latched position at which the latch member 12 fully engages with the striker pin. The close lever 21 is mechanically linked through an intermediate linkage, namely a force-transmitting cable 22, a cable joint 23, a sector gear 24 (an output gear) and a motor-driven pinion gear 25, to a reversible geared motor 26. Reference numeral 27 denotes a bracket provided for mounting the door closing device 20 onto the door panel. The close lever 21 rotates in the direction indicated by the arrow B1 through the cable 22 by way of rotation of the pinion gear 25 in the direction indicated by the arrow D1 owing to normal-rotation of the motor 26 in the normal-rotation direction. Thereafter, when the motor 26 is driven in the reverse-rotation direction, and thus the pinion gear 25 is rotated in the direction indicated by the arrow D2, the close lever 21 rotates in the direction indicated by the arrow B2 by the aid of the bias of a return spring 28 and returns to the stand-by position (the neutral position). An open lever 13 mechanically linked to the latch member 12 and a half-latch detection switch 29 are provided for detecting whether or not the latch member 12 reaches the half-latched position. That is, the half-latch detection switch 29 is switched ON by the open lever 13, when the latch member 12 reaches the half-latched position. In the shown embodiment, the half-latch detection switch 29 consists of a conventional normally-open type limit switch or micro-switch having a spring-loaded plunger-type mechanical contact for a desired switching action. In more detail, when the latch member 12 is kept at the half-latched position, the cammed surface of the open lever 13 continues to push the mechanical contact of the detection switch 29, and as a result the mechanical contact is maintained at its retracted position, thus primarily switching the detection switch 29 ON. Owing to the cammed profile of the open lever 13, the mechanical contact of the detection switch 29 is shifted from the retracted position to the extended position and thus the detection switch 29 is switched OFF again, when the latch member 12 moves apart from the half-latched position in the rotational direction C1 toward the fully-latched position. As soon as the latch member 12 reaches the fully-latched position, the mechanical contact is maintained again at its retracted position and thus the detection switch 29 is secondarily switched ON. The secondarily switched-ON operation of the detection switch 29 can be utilized to detect whether or not the latch member 12 is maintained at the fully-latched position. When quickly closing the sliding door 1 with great momentum during manual door operation, the cammed surface of the open lever 13 will push the mechanical contact of the detection switch 29 twice for an excessively short time interval. Due to an inherent switching characteristic of the detection switch 29 with the spring-loaded mechanical contact, there is a possibility that the secondarily switched-ON operation of the switch 29 cannot be completed, during quick door closing. For the reasons set forth above, the system of the embodiment utilizes variations in load applied to the motor 26 to precisely detect as to whether or not the latch member 12 is kept at the fully-latched position, as explained later. Once the latch member 12 has been shifted to the fully-latched position, the rotational movement of the latch member 12 is prevented by a stopper (not shown). With the latch member 12 urged to and maintained at the fully-latched position, the normal-rotation of the motor 26 is restricted and stopped through the above-noted intermediate linkage. On the other hand, when the close lever 21 rotates in the direction indicated by the arrow B2 and then reaches the stand-by position, the sector gear 24 abuts the bracket 27 and thus the reverse-rotation of the motor 26 is prevented.

The door closing device 20 is controlled by a controller 50. When the half-latch detection switch 29 detects that the latch member 12 reaches the half-latched position, the close lever 21 starts to rotate in the direction indicated by the arrow B1 by way of normal-rotation of the motor 26 and then the latch member 12 is forcibly rotated to the fully-latched position in the direction indicated by the arrow C1. The above-mentioned forcible rotational motion of the latch member 12 to the fully-latched position will be hereinafter referred to as an "auto door-close operation" and abbreviated to a "door-close operation". When a full-latch detection section 57, as explained later, detects that the latch member 12 reaches the fully-latched position, the motor 26 is rotated in the direction of reverse-rotation and thus the close lever 21 is rotated in the direction indicated by the arrow B2 by way of the bias of the return spring 28 and then reaches the stand-by position. When a stand-by position detection section 58, as explained later, detects that the close lever 21 reaches the stand-by position, the motor 26 is stopped. In this manner, a series of final closing movements of the door terminates. The above-mentioned returning motion of the close lever 21 to the stand-by position (the neutral position) will be hereinafter referred to as a "return-to-neutral operation". Returning to FIG. 1, the door closing device 20 is connectable to a car battery 3 (See FIG. 4) through a pair of electric-power feeding portions 32 and 33. As seen in FIG. 1, the moveable power-feeding portion 32 is attached to the sliding door 1, while the stationary power-feeding portion 33 is attached to the vehicle body 2. The moveable power-feeding portion 32 is brought into electric-contact with the stationary power-feeding portion 33, when the body opening becomes less than or equal to a predetermined opening degree, that is when the sliding door 1 reaches a predetermined partly-opened position via which partly-opened position the latch member 12 reaches the half-latched position during door closing. The feeding portions 32 and 33 are so designed that the moveable power-feeding portion 32 comes into electric-contact with the stationary power-feeding portion 33 before the latch member 12 rotates to the half-latched position during the manual door closing operation. With the two power-feeding portions 32 and 33 in contact, a power-supply circuit for the controller 50 is established. For example, in a conventional manner, the stationary power-feeding portion 33 may consist of a plurality of stationary electrical contacts, whereas the moveable power-feeding portion 32 may consist of a plurality of spring-loaded, plunger-type electrical contacts. To enhance safety, if the outside handle of the sliding door 1 is manually operated by the operator during operation of the door closing device or during activation of the drive motor, the controller 50 operates to stop the final closing action of the door closing device 20 and additionally the state of the device 20 is shifted from the auto door-close state to the stand-by state in which the close lever 21 is maintained at the stand-by position. The outside-handle operation is detected by a handle switch 31 such as a limit switch or a micro-switch whose contact is mechanically linked through a handle lever 30 to the outside lever. Thus, when the operator pulls the outside handle of the door 1 for the purpose of opening the door, the lock is released manually and the door can be opened freely.

Figure 4:
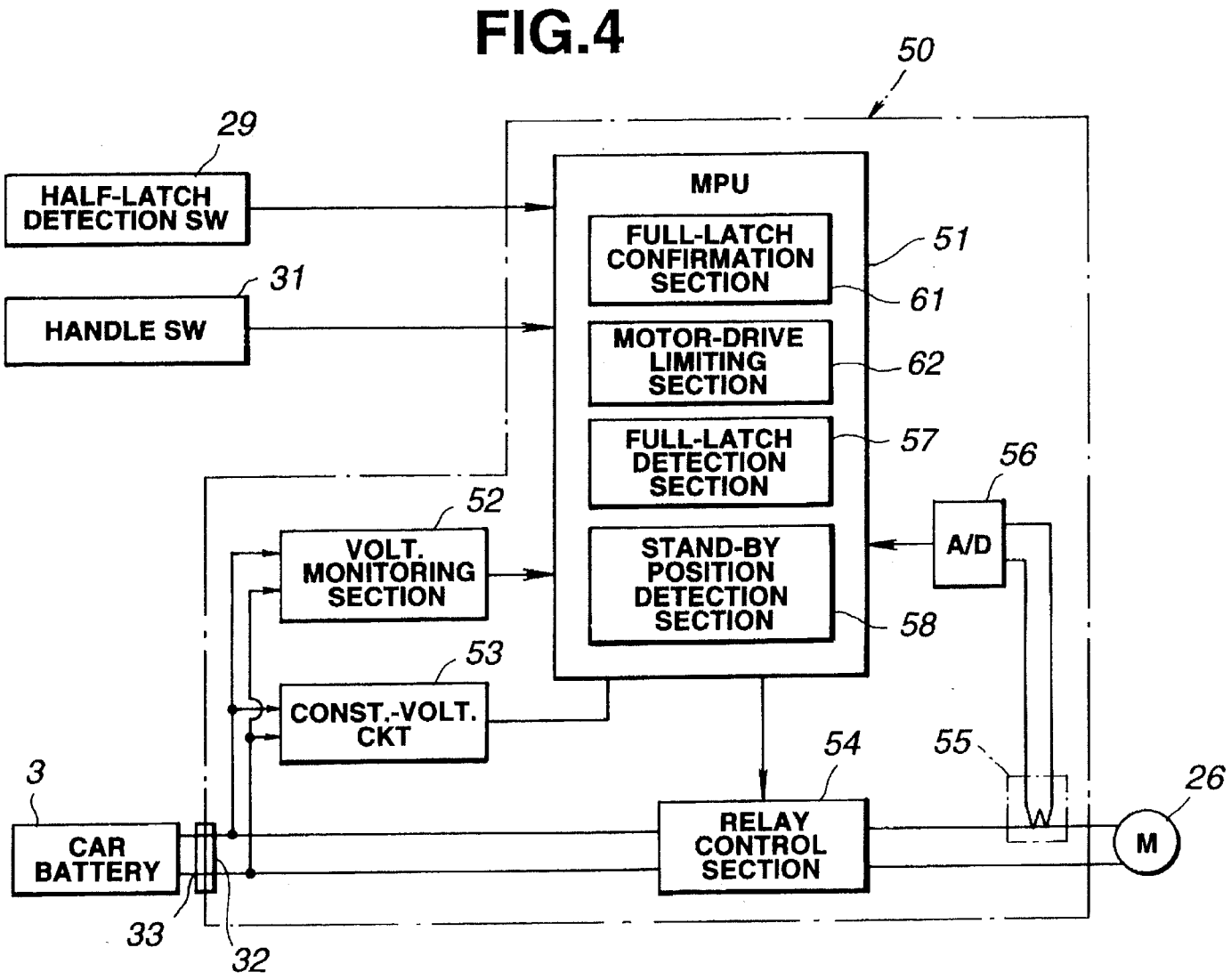
FIG. 4 is a block diagram illustrating a control system for the powered vehicle door closing system of the first embodiment.

Referring now to FIG. 4, there is shown a block diagram illustrating the controller 50. The controller 50 includes a central processing unit (a micro processor abbreviated to "MPU") 51, a voltage monitoring section 52 provided for monitoring a voltage level of the car battery 3, a constant-voltage circuit 53, a relay control section 54 provided in a motor drive circuit between the battery 3 and the motor 26, a current detection section 55 provided for detecting a drive current for the motor 26, and an analog-to-digital converter (A/D converter) 56 provided for converting an analog signal (the current signal from the detection section 55) into a digital signal. The micro processor 51 includes the full-latch detection section 57, the stand-by position detection section 58, a full-latch confirmation section 61 and a motor-drive limiting section 62. As explained later, the full-latch detection section 57 and the stand-by position detection section 58 are both responsive to signals from the half-latch detection switch 29, from the handle switch 31, and from the A/D converter 56, in order to detect that the latch member 12 has rotated to the fully-latched position and to detect that the close lever 21 has rotated to the stand-by position, respectively. Additionally, the micro processor 51 controls a normal-rotation relay and a reverse-rotation relay both employed in the relay control section 54 in such a manner as to drive the drive motor 26 in the normal-rotation direction or in the reverse-rotation direction. In consideration of inherent switching characteristics of the detection switch 29 and the handle switch 31, it is desirable that a normal switching action of the respective switches 29 and 31 is confirmed by determining whether or not a switched-ON or switched-OFF state continues for a predetermined period of time or more. As detailed later, the full-latch confirmation section 61 and the motor-drive limiting section 62 are cooperative to each other so as to limit re-activation of the motor 26 when the full-latch confirmation section 61 decides that the latch member 12 has already been shifted to and maintained at the fully-latched position.

Figure 8:
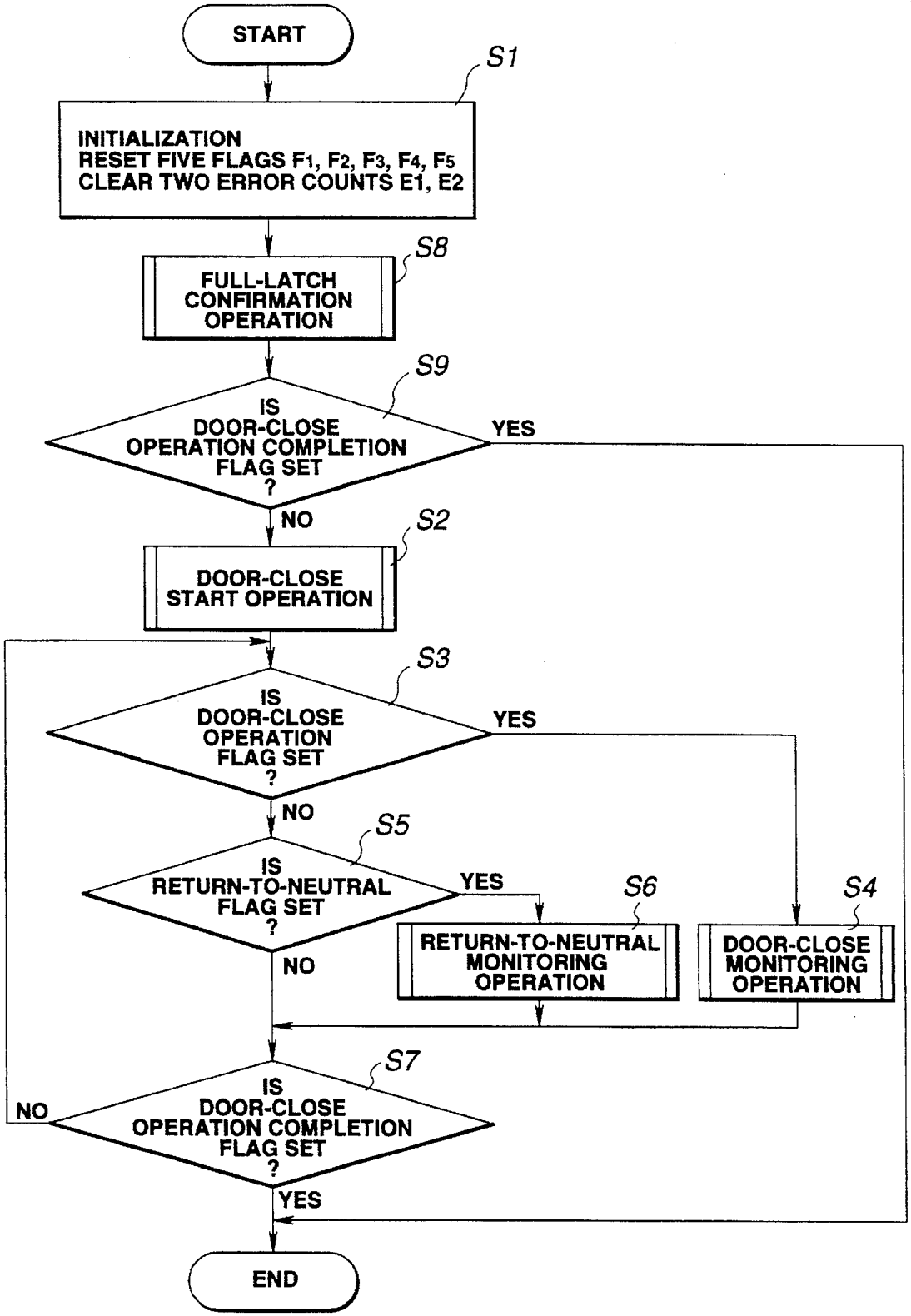
FIG. 8 is a flow chart illustrating a main routine executed the system of the first embodiment.

Referring to FIG. 8, there is shown a main program or a main routine executed by the controller 50. This main routine is executed as time-triggered interrupt routines to be triggered every predetermined sampling time interval. The control procedure of the controller 50 will be hereinafter described in detail in accordance with the flow chart indicated in FIG. 8.

In step S1, initialization is executed so that five flags $F_1$, $F_2$, $F_3$, $F_4$ and $F_5$, as described later, are reset, and two error counts E1 and E2 are cleared.

The above-noted initialization is executed at a timing when electric-power is supplied to the controller 50 through the power-supply circuit established with the power-feeding portions 32 and 33 in contact, that is, when the sliding door 1 reaches a predetermined partly-opened position in which the door 1 is almost closed to a degree below the predetermined opening degree of the body opening just before the latch member 12 is rotated to the half-latched position. That is, the feeding portions 32 and 33 also serve as a switch for detection of the predetermined partly-opened position of the door 1. Such a connection between the power-feeding portions 32 and 33 is based on the closing movement of the sliding door 1. Thus, the connection will be hereinafter referred to as a "normal connection". Due to vibrations in the automotive vehicle, there is a possibility that the power-feeding portions 32 and 33 are temporarily accidentally disconnected from each other and then the opposing feeding portions 32 and 33 are connected to each other once again. In this case, the power-supply circuit, which is opened once owing to the undesired vibrations, will be closed again. Such a re-connection of the feeding portions 32 and 33 will be hereinafter referred to as an "abnormal connection". After step S1, the procedure flows to step S8.

In step S8, the full-latch confirmation operation (corresponding to the sub-routine indicated in FIG. 14) is executed. The full-latch confirmation operation is actually achieved by way of the full-latch confirmation section 61 and the motor-drive limiting section 62.

In step S9, a test is made to determine whether or not a door-close operation completion flag $F_3$ which is representative of a state of completion of the auto door-close operation of the door closing device 20, is set. When the answer to step S9 is affirmative (YES), i.e., in case that the door-close operation completion flag $F_3$ is set, the closing control of the door closing device 20 terminates without activating the motor 26. When the answer to step S9 is negative (NO), i.e., in case that the door-close operation completion flag $F_3$ is reset, the door-close start operation (corresponding to the sub-routine indicated in FIG. 9) is executed at step S2. Thereafter the procedure flows to step S3.

In step S3, a test is made to determine whether or not the door-close operation flag $F_1$ is set. The door-close operation flag=1 means that the door closing device 20 is energized and the door-close operation is executed currently. When the answer to step S3 is affirmative (YES), i.e., in case that the door-close operation flag $F_1$ is set, step S4 proceeds in which the door-close monitoring operation (corresponding to the sub-routine indicated in FIG. 10) is executed. When the answer to step S3 is negative (NO), i.e., in case that the door-close operation flag $F_1$ is reset, step S5 proceeds in which a test is made to determine whether or not the return-to-neutral flag $F_2$ is set. The return-to-neutral flag=0 means that the return-to-neutral operation has already been completed. When the answer to step S5 is affirmative (YES), i.e., in case that the return-to-neutral flag $F_2$ is set to "1", step S6 proceeds in which the return-to-neutral monitoring operation (corresponding to the sub-routine indicated in FIG. 11) is executed. When the answer to step S5 is negative (NO), i.e., in case that the return-to-neutral flag $F_2$ is reset to "0", step S7 enters.

Figure 10:
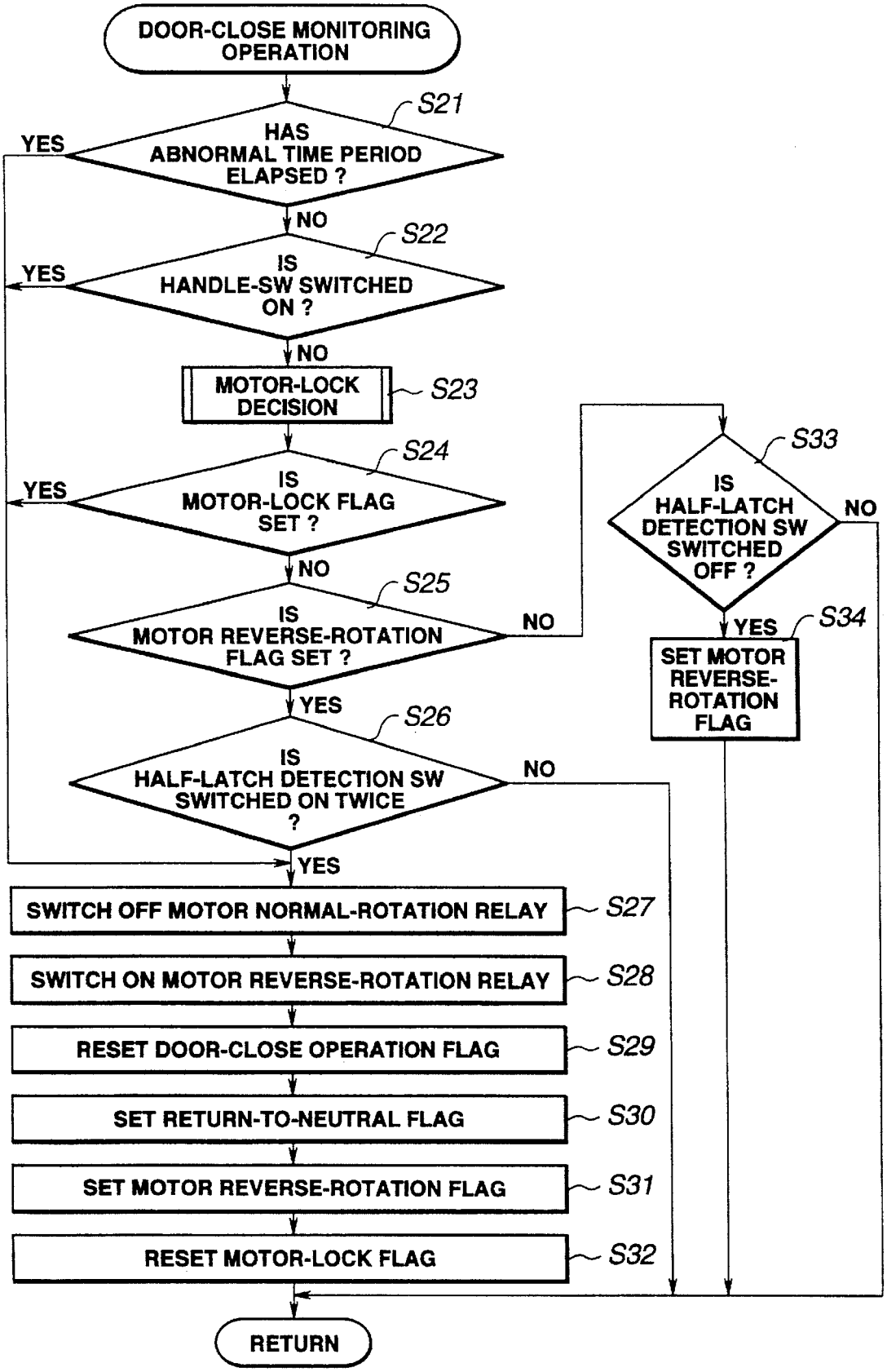
FIG. 10 is a flow chart explaining the door-close monitoring operation corresponding to step S4 of FIG. 8.
Figure 11:
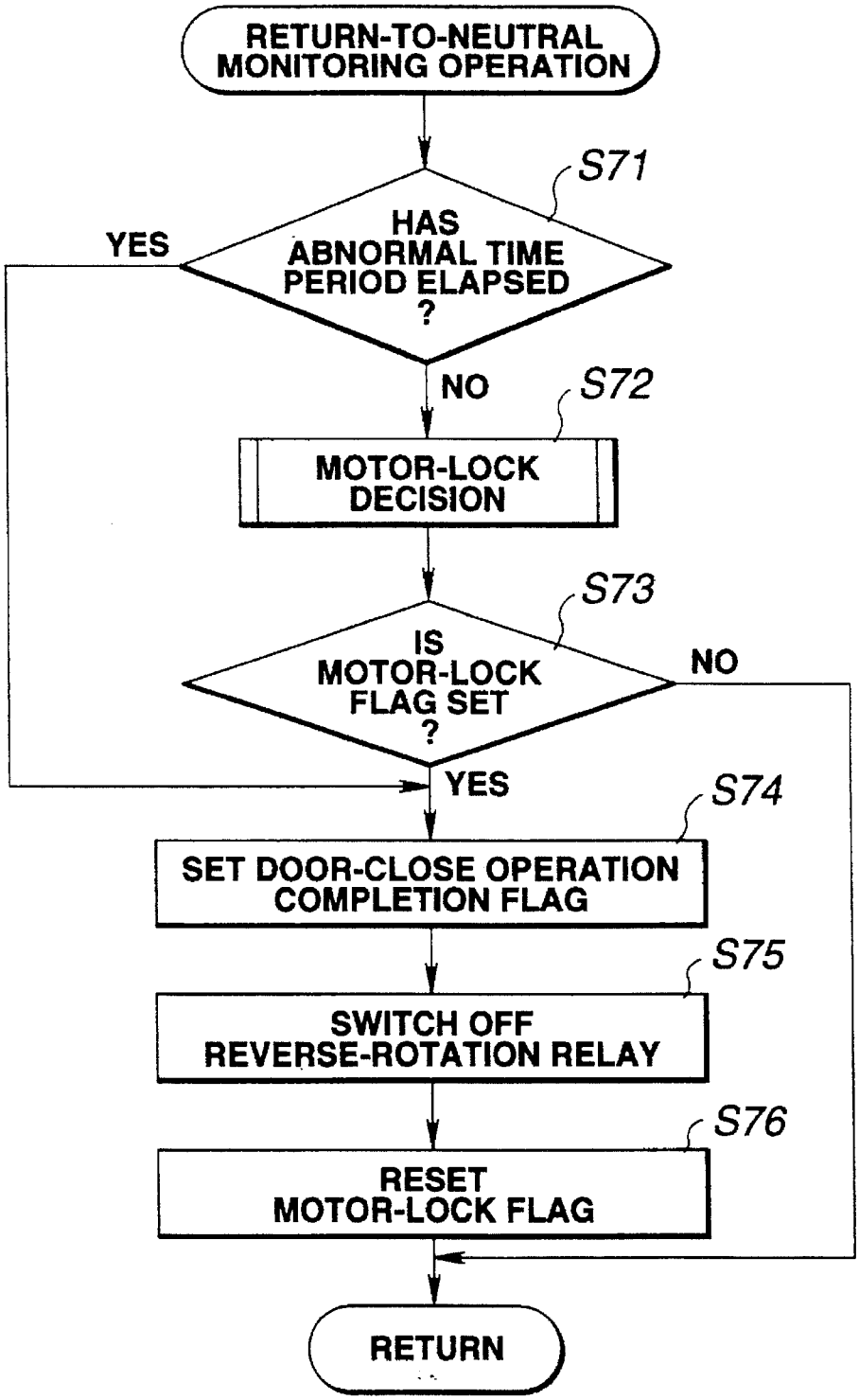
FIG. 11 is a flow chart explaining the return-to-neutral monitoring operation corresponding to step S6 of FIG. 8.

In conjunction with the respective ones of the door-close monitoring operation illustrated in FIG. 10 and the return-to-neutral monitoring operation illustrated in FIG. 11, the motor-lock decision operation (corresponding to the sub-routine indicated in FIG. 12) is executed. The motor-lock decision is made by means of the full-latch detection section 57 during the door-close monitoring operation. On the other hand, during the return-to-neutral operation, that is, during the return-to-neutral monitoring operation, the motor-lock decision is made by means of the stand-by position detection section 58.

In step S7, a test is made to determine whether or not the door-close operation completion flag $F_3$ is set. When the answer to step S7 is affirmative (YES), i.e., in case that the door-close operation completion flag is set, a series of auto door closing actions of the door closing device 20 terminates. When the answer to step S7 is negative (NO), i.e., in case that the door-close operation completion flag $F_3$ is reset, the procedure jumps to step S3.

Figure 14:
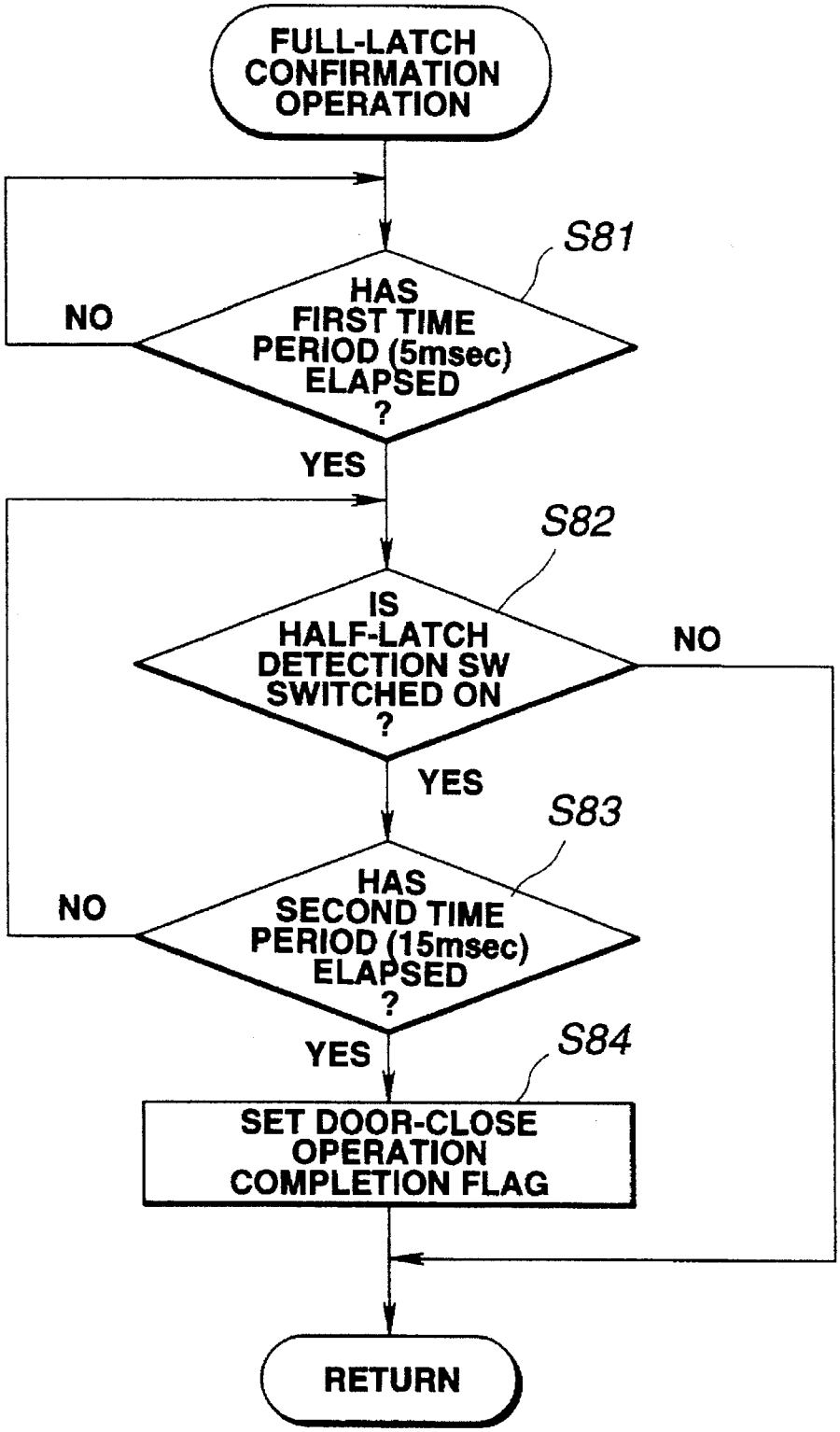
FIG. 14 is a flow chart explaining the full-latch confirmation operation of the system of the first embodiment.

The above-noted full-latch confirmation operation is hereinbelow explained in detail in accordance with the flow chart indicated in FIG. 14.

In step S81, a test is made to determine whether or not a first predetermined time period such as 5 msec has elapsed from the time when the feeding portion 32 was brought into electric-contact with the feeding portion 33 and thus the power-supply circuit for the controller 50 was closed. If the answer to step S81 is negative (NO), the test at step S81 is repeatedly executed every predetermined time interval until the first predetermined time period (5 msec) has elapsed. When the answer to step S81 is affirmative (YES), step S82 proceeds in which a test is made to determine whether the half-latch detection switch 29 is switched ON or OFF. When the answer to step S82 is affirmative (YES), that is when the half-latch detection switch 29 is switched ON, step S83 proceeds in which a test is made to determine whether a second predetermined time period such as 15 msec has elapsed from the time when the feeding portion 32 was brought into electric-contact with the feeding portion 33. When the answer to step S82 is negative (NO), that is when the half-latch detection switch 29 is switched OFF, the procedure returns again to step S81. In other words, by way of steps S81, S82 and S83, a determination is made as to whether the half-latch detection switch 29 is switched ON within a preset full-latch confirmation time-period from the first elapsed time such as 5 msec to the second elapsed time such as 15 msec. When the answer to step S83 is affirmative (YES), that is in case that the half-latch detection switch 29 is switched ON within the preset full-latch confirmation time-period after the power-supply circuit for the controller 50 has been closed, the controller determines that the latch member 12 has already been rotated to the fully-latched position. Thereafter, the door-close operation completion flag $F_3$ is set at step S84. When the answer to step S83 is negative (NO), the procedure returns from step S83 to step S82.

Figure 13:
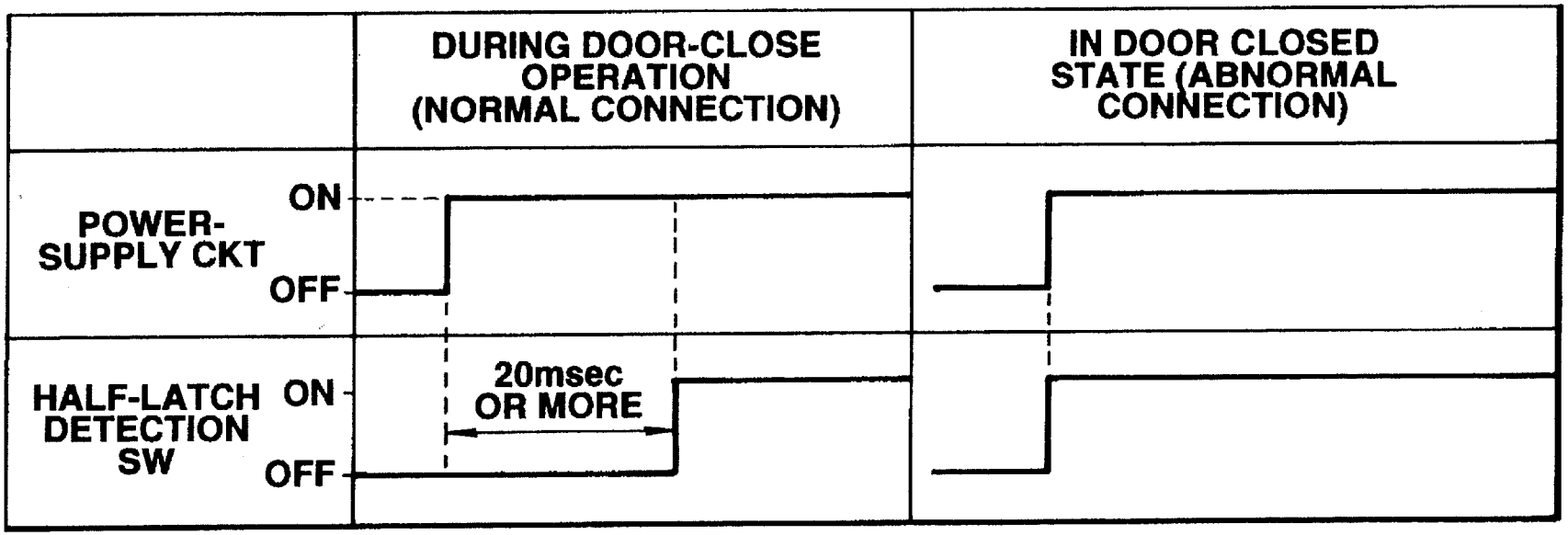
FIG. 13 is a time chart explaining the timing of a switched-ON operation of the half-latch detection switch of the system of the first embodiment.

As previously explained, the half-latch detection switch 29 is switched ON when the latch member 12 is rotated to and maintained at the half-latched position during the manual door operation, and switched OFF when the latch member 12 moves away from the half-latched position toward the fully-latched position, and switched ON once again when the latch member 12 is rotated to and maintained at the fully-latched position. As can be appreciated, in case of the above-noted "normal connection" between the feeding portions 32 and 33, there is a slight time lag until the half-latch detection switch 29 is actually switched ON from the time when the sliding door 1 reaches the predetermined partly-opened position. Thus, as seen in the left-hand side of the time chart of FIG. 13, in case of the "normal connection", the half-latch detection switch 29 is switched ON with a time lag such as 20 msec or more until the latch member 12 is rotated to the half-latched position after the power-supply circuit for the controller has been closed. In case of the above-noted "abnormal connection" (re-connection) between the feeding portions 32 and 33, the power-supply circuit for the controller is closed again although the latch member 12 is maintained at the fully-latched position and the sliding door is also maintained at the fully-closed position. In this case, as seen in the right-hand side of FIG. 13, there is no time lag between the time when the power-supply circuit is closed and the time when the half-latch detection switch 29 is switched ON because the half-latch detection switch 29 has already been switched ON when the power-supply circuit is closed again. In consideration of the above-mentioned time lag such as 20 msec or more, the full-latch confirmation time-period is properly preset and defined between the first elapsed time (5 msec) and the second elapsed time (15 msec) after closing the power-supply circuit. That is to say, a decision of the fully-latched state of the latch member 12 can be made by recognizing the switched-ON state of the half-latch detection switch 29 within the preset full-latch confirmation time-period. As set forth above, in the shown embodiment, although the preset full-latch confirmation time-period is defined between the first elapsed time 5 msec (See step S81) and the second elapsed time 15 msec (See step S83), the preset full-latch confirmation time-period may be defined between 0 (corresponding to the time when the power-supply circuit is closed with the feeding portions 32 and 33 in contact) and a predetermined elapsed time such as 15 msec counted from the time when the power-supply circuit is closed. That is, step S81 may be eliminated.

As can be appreciated from the above, even in case of the "abnormal connection" of the feeding portions 32 and 33, the final door closing action of the door closing device 20 ends reliably, without any ineffective re-activation of the motor 26. This eliminates ineffective auto-closing action.

Figure 9:
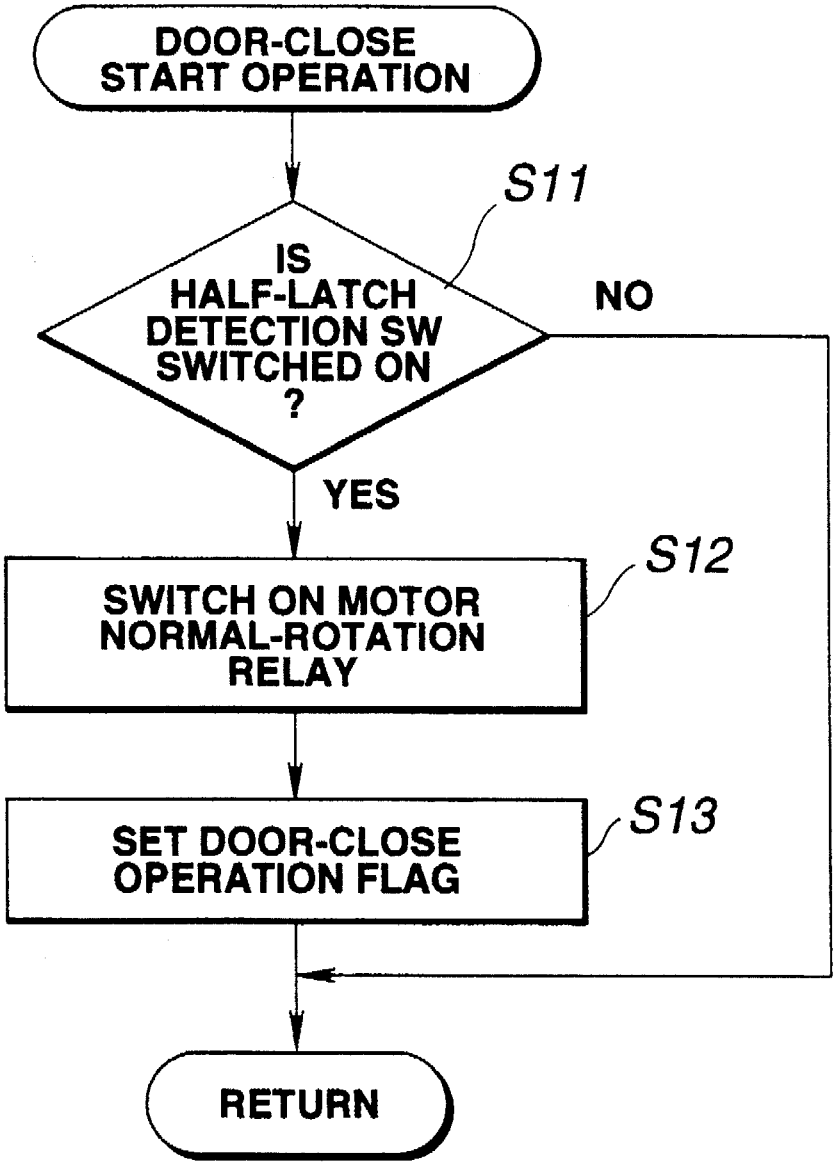
FIG. 9 is a flow chart explaining the door-close start operation corresponding to step S2 of FIG. 8.

The above-noted door-close operation is hereinbelow described in detail in accordance with the flow chart indicated in FIG. 9.

Firstly, in step S11, a test is made to determine whether the half-latch detection switch 29 is switched ON or OFF. Only when the answer to step S11 is affirmative (YES), that is, the half-latch detection switch 29 is switched ON, the procedure transfers to step S12.

In step S12, the normal-rotation relay employed in the relay control section 54 is switched ON.

In step S13, the door-close operation flag $F_1$ is set. Through the flow from step S11 via step S12 to step S13, with the motor normal-rotation relay switched ON, the motor normal-rotation circuit is established to initiate normal-rotation of the motor 26, thus permitting the close lever 21 to rotate in the direction indicated by the arrow B1 (See FIG. 3).

In this manner, as soon as the door-close operation flag $F_1$ is set, the sub-routine related to the door-close monitoring operation is executed in accordance with the flow chart indicated in FIG. 10.

Figure 12:
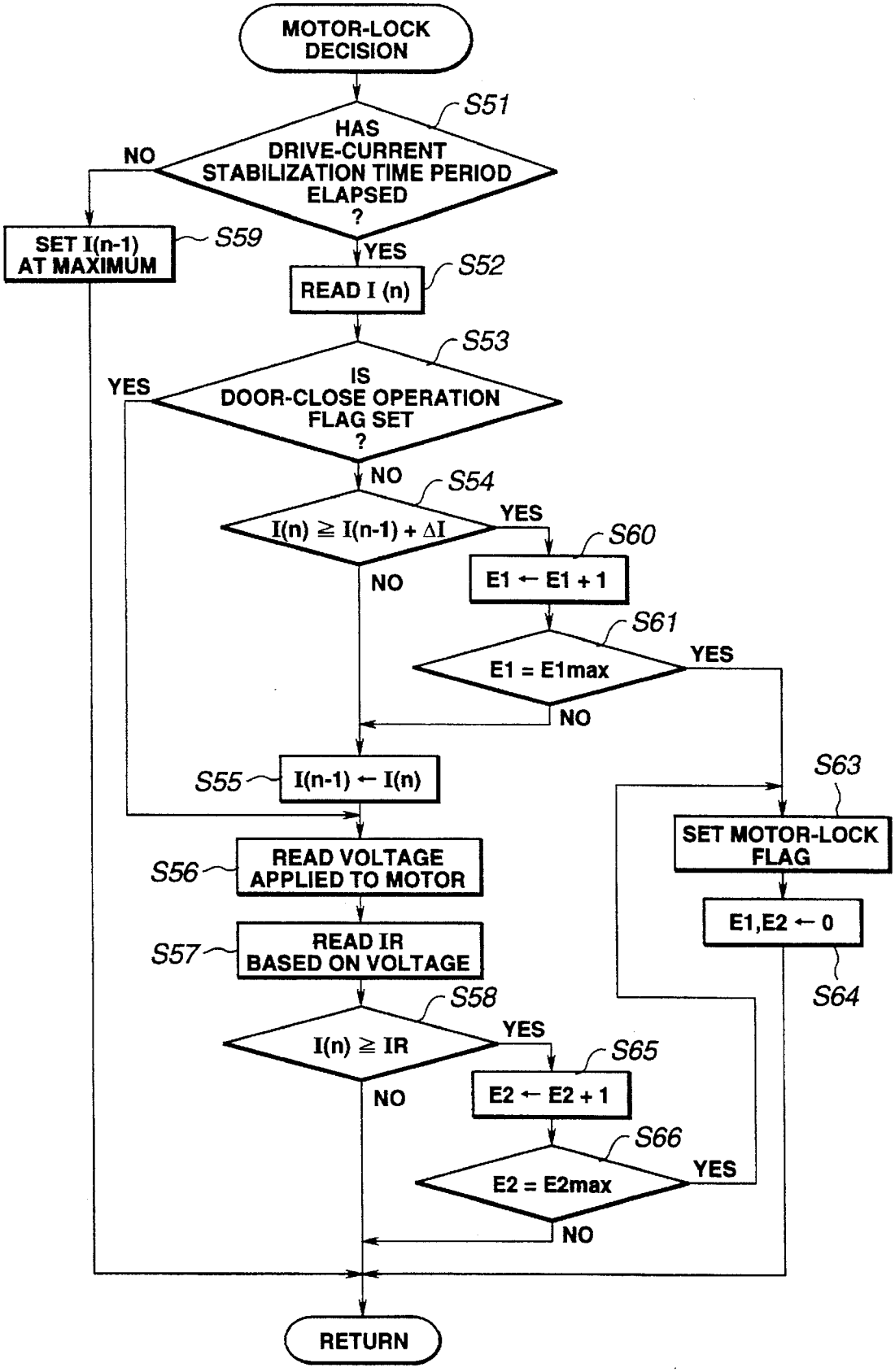
FIG. 12 is a flow chart explaining the motor-lock decision operation illustrated in step S23 of FIG. 10 and in step S72 of FIG. 11.

In step S21, a test is made to determine whether or not a predetermined abnormal time period has elapsed from the time when the motor normal-rotation relay is switched ON. As appreciated from steps S21, S22 and S23, on the assumption that the handle switch 31 is not yet switched ON within the predetermined abnormal time period, the procedure flows from step S21 via step S22 to step S23 at which the motor-lock decision operation is executed as shown in FIG. 12. When the answer to step S21 is affirmative (YES), the controller decides that abnormality takes place during the auto door-close operation (during normal rotation of the motor 26), and then step S27 enters. Conversely, when the answer to step S21 is negative (NO), step S22 proceeds at which a test is made to determine whether the handle switch 31 is switched ON or OFF. When the answer to step S22 is affirmative (YES), i.e., when the handle switch 31 is switched ON, the controller decides that the sliding door 1 is in the door opening state, and then step S27 enters.

In step S27, the motor normal-rotation relay is switched OFF. Thereafter, the procedure flows through steps S28, S29, S30 and S31 to step S31.

In step S28, the reverse-rotation relay of the motor 26 is switched ON to initiate reverse-rotation of the motor 26.

In step S29, the door-close operation flag $F_1$ is reset.

In step S30, the return-to-neural flag $F_2$ is set.

In step S31, the motor reverse-rotation flag $F_5$ is set.

In step S32, the motor-lock flag $F_4$ is reset.

When the answer to step S22 is negative (NO), i.e., when the handle switch 31 is switched OFF, step S23 proceeds at which the motor-lock decision procedure is executed in accordance with the flow chart illustrated in FIG. 12.

In step S51, a test is made to determine whether or not a predetermined time period $t_0$, required for stabilization of the drive current I of the motor 26, has elapsed from the time when the motor normal-rotation relay or the motor reverse-rotation relay has been switched ON. The predetermined time period $t_0$ will be hereinafter referred to as a "drive-current stabilization time period $t_0$". When the answer to step S51 is affirmative (YES), i.e., in case that the drive-current stabilization time period $t_0$ has elapsed, step S52 proceeds in which the current value I(n) of the drive current of the motor 26 is read. Thereafter, step S53 enters. In contrast, when the answer to step S51 is negative (NO), i.e., in case that the drive-current stabilization time period $t_0$ has not yet elapsed, step S59 proceeds in which the previous value I(n−1) of the motor drive-current is set at a predetermined maximum current.

In step S53, a test is made to determine whether or not the door-close operation flag is set. When the answer to step S53 is affirmative (YES), that is, when the door-close operation flag is set to "1", the procedure jumps to step S56. When the answer to step S53 is negative (NO), that is, when the door-close operation flag is reset to "0", step S54 proceeds in which the current value I(n) of the motor drive-current is compared with a comparison current represented by the formula $\{I(n-1)+\Delta I\}$, where I(n−1) denotes the previous value of the drive current, derived during the previous sampling, and ΔI denotes a predetermined positive rate-of-change threshold of the drive current. In step S54, in case that the current value I(n) is greater than or equal to the comparison current $\{I(n-1)+\Delta I\}$, the controller decides that the motor 26 is in an overload state. In this case, the procedure shifts from step S54 to step S60 in which a first error count E1 is incremented by "1". Thereafter, the procedure flows to step S61 in which a test is made to determine whether or not the first error count E1 reaches a predetermined upper limit E1max. In the event that the first error count E1 reaches the upper limit E1max, the controller decides that the latch member 12 is restricted or locked in the fully-latched position and also the rotational movement of the close lever 21 (in the direction indicated by the arrow B1) is prevented. Thereafter, the motor-lock flag is set in step S63, and then the first error count E1 is cleared at step S64. On the other hand, in the event that the current value I(n) is less than the comparison current $\{I(n-1)+\Delta I\}$, step S55 proceeds in which the previous value I(n−1) is updated by the current value I(n). In the event that the first error count E1 is less than the upper limit E1max, step S55 enters in which the current value I(n) of the drive current is stored as the previous value I(n−1) in a predetermined memory address in the memory employed in the central processing unit 51.

In the case that the motor-lock flag is set at step S63 of FIG. 12, the procedure indicated in FIG. 10 flows from step S24 via step S27 to step S32, so as to initiate the reverse-rotation of the motor 26. Thereafter, the previously-described return-to-neutral operation begins.

Hereinbelow is described in detail the drive current I of the motor 26.

Figure 5:
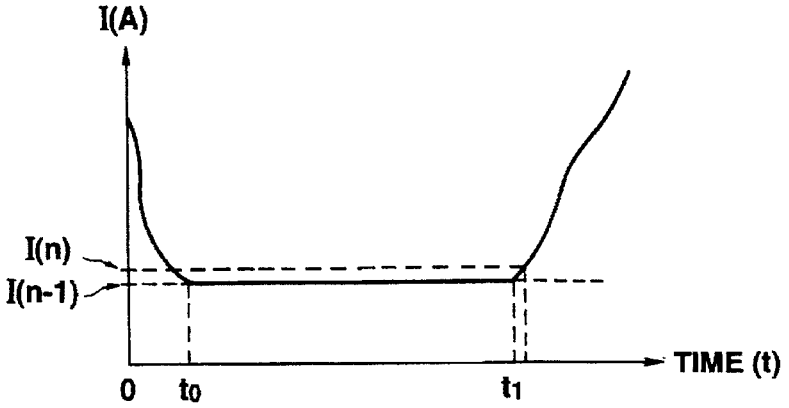
FIG. 5 is a time chart explaining a method for motor-lock decision depending on variations in a drive current of the motor shown in FIG. 1.
Figure 6:
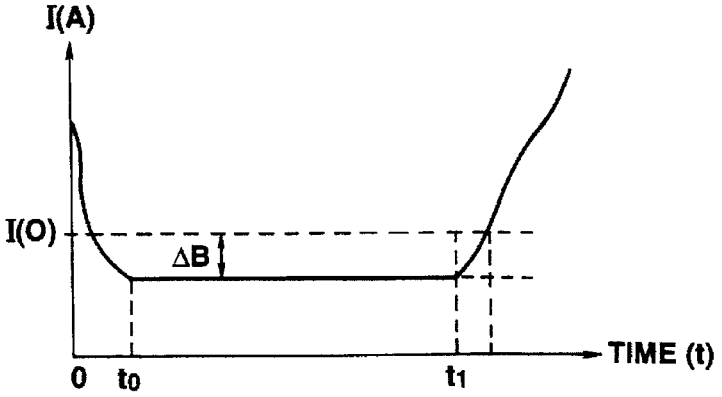
FIG. 6 is a time chart explaining another method for motor-lock decision depending on variations in a drive current of the motor.

As seen in the graph illustrated in FIG. 5, during activation of the motor 26, the motor drive-current I almost stabilizes from the time when the predetermined drive-current stabilization time period $t_0$ has elapsed, up to the time $t_1$ when the rotational movement of the motor 26 has been restricted. From just after the time $t_1$, the drive current I rises rapidly. Thus, when the deviation between the current value I(n) and the previous value I(n−1) exceeds the predetermined threshold ΔI, it can be decided that the motor 26 is restricted. To avoid misjudgment owing to a temporary rise in the motor load, and to precisely set the motor-lock flag $F_4$, the controller decides that the motor 26 is restricted or locked when the particular condition defined by the inequality $\{I(n) \geqq I(n-1)+\Delta I\}$ is satisfied for a preset period of time, that is to say, when the error count E1 reaches the predetermined upper limit E1max. Alternatively, as appreciated from the graph illustrated in FIG. 6, a drive-current value I(O) measured during no-load running of the motor 26 may be compared with the actual drive current I measured during auto door-close operation, so as to decide as to whether the rotational movement of the motor 26 is restricted or locked. That is, the controller can decide as to whether or not the rotational movement of the motor 26 is restricted, by comparing the deviation between the drive-current value I(O) and the actual drive current I with a predetermined threshold value ΔB. In lieu thereof, in order to detect changes in load applied to the motor 26, a rate-of-change (a differential) of the drive current I with time or a change in rotational speed of the motor 26 may be utilized.

In addition to the above-mentioned procedure for setting the motor-lock flag, in the shown embodiment, fluctuations in voltage applied to the motor 26 through the relay control section 54 are further considered. To more precisely set the motor-lock flag $F_4$, the controller utilizes comparison results between the actual drive current I and a motor-lock current IR based on the voltage actually applied to the motor. That is, for the purpose of a more precise motor-lock decision, steps S56 to S58 and steps S65 and S66 are provided.

Returning to FIG. 12, in step S56, a value of the voltage signal from the voltage monitoring section 52 (See FIG. 4) is read.

Figure 7:
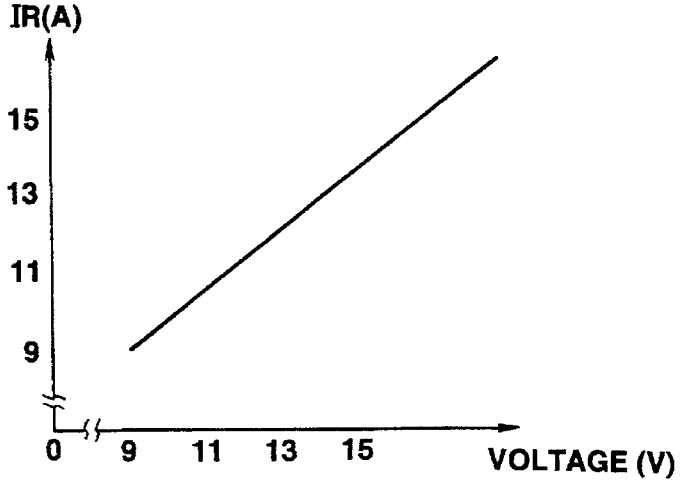
FIG. 7 is a graph illustrating the relationship between the power-source voltage and the motor-lock current.

In step S57, a motor-lock current IR is read on the basis of the voltage derived at step S56, in accordance with the correlation illustrated in FIG. 7 which is pre-stored in the form of a data map in the memory of the MPU 51 in a conventional manner. As can be appreciated from the voltage versus motor-lock current characteristic shown in FIG. 7, the motor-lock current IR tends to increase essentially in proportion to an increase in the supply voltage.

In step S58, the motor-lock current IR is compared with the current value I(n) of the motor drive-current. When the current value I(n) is equal to or greater than the motor-lock current IR, step S65 proceeds in Which a second error count E2 is incremented by "1". Thereafter, step S66 enters in which the second error count E2 is compared with a predetermined upper limit E2max in the same manner as step S61. In the shown embodiment, the upper limit E2max for the second error count E2 is set at the same value as the upper limit E1max for the first error count E1. When the second error count E2 reaches the upper limit E2max, the controller outputs a motor-lock decision instruction indicating that the motor is restricted or locked. In the presence of output of the motor-lock decision instruction, the motor-lock flag is set at step S63 and then the first and second error counts E1 and E2 are both cleared to "0 "at step S64.

Returning to FIG. 10, at step S24, in case that the motor-lock flag is reset, step S25 enters in which a test is made to determine whether the motor reverse-rotation flag is set. When the answer to step S25 is negative (NO), that is, when the motor reverse-rotation flag is reset, step S33 proceeds in which a test is made to determine whether the half-latch detection switch 29 is switched OFF. When the answer to step S33 is affirmative, the motor reverse-rotation flag is set at step S34. As appreciated from the flow from step S25 via step S33 to step S34, the motor reverse-rotation flag can be set when the latch member 12 is rotating away from the half-latched position towards the fully-latchedposition. In this manner, after the motor reverse-rotation flag has been set, the procedure flows from step S25 to step S26 at which a test is made to determine whether or the half-latch detection switch 29 is switched ON twice. When the answer to step S26 is affirmative (YES), that is, when the half-latch detection switch 29 is switched ON once with the latch member 12 passing through the half-latched position and then the switch 29 is switched ON again with the latch member 12 maintained at the fully-latched position, the procedure flows from step S26 through steps S27, S28, S29, S30 and S31 to step S32, so as to initiate the reverse-rotation of the motor 26 and consequently to execute the return-to-neutral operation.

The return-to-neutral operation and the return-to-neutral monitoring operation are hereinbelow described in detail.

After the return-to-neutral flag and the motor reverse-rotation flag are both set, the return-to-neutral operation begins by driving the motor 26 in the reverse-rotation direction. With the return-to-neutral flag F2 set, as seen in the main routine shown in FIG. 8, the procedure transfers from step S5 to step S6, so as to simultaneously execute the return-to-neutral monitoring operation in accordance with the flow chart shown in FIG. 11.

Referring to FIG. 11, in step S71, a test is made to determine whether or not the above-noted predetermined abnormal time period has elapsed from the time when the motor reverse-rotation relay has been switched ON. The answer to step S71 is negative (NO), i.e., when the abnormal time period has not yet elapsed, step S72 proceeds in which the previously-noted motor-lock decision procedure is executed in accordance with the flow chart of FIG. 12. Conversely, when the answer to step S71 is affirmative (YES), i.e., in case that the predetermined abnormal time period has elapsed, the controller decides that abnormality takes place during the return-to-neutral operation (during reverse rotation of the motor 26), and then step S74 enters in which the door-close operation completion flag is set. Thereafter, the motor reverse-rotation relay is switched OFF at step S75, and then the motor-lock flag is reset at step S76.

During the motor-lock decision operation at step S72 of FIG. 11 (the return-to-neutral monitoring operation), changes or variations in the drive current I are monitored in the same manner as during the motor-lock decision operation at step S23 of FIG. 10 (the door-close monitoring operation). Based on changes (a steep current-rise) in the drive current I monitored, the controller outputs a decision instruction representing that the close lever 21 is rotated to the stand-by position and also the sector gear 24 abuts the inner wall of the bracket 27, and thus the reverse-rotation of the motor 26 is restricted or locked. In the presence of an output of the decision instruction, the motor-lock flag is set. With the motor-lock flag set to "1", the procedure of FIG. 11 flows from step S73 through steps S74 and S75 to step S76.

As set forth above, according to the first embodiment, the normal-rotation of the motor 26 can be forcibly stopped when the latch member 12 has been rotated to the fully-latched position, and the reverse-rotation of the motor 26 can be forcibly stopped when the latch member 12 has been returned to the stand-by position. Additionally, on the basis of changes in the drive current I, namely, changes in load applied to the motor 26, the controller can decide that the latch member 12 reaches the fully-latched position or the stand-by position. In other words, for the purpose of a precise detection for the restricted positions of the latch member 12, namely the fully-latched position and the stand-by position, the door closing system of the first embodiment requires a comparatively simple detecting structure. Thus, the entire structure of the door closing device 20 can be simplified or small-sized to assure a more inexpensive system.

Second embodiment

Figure 15:
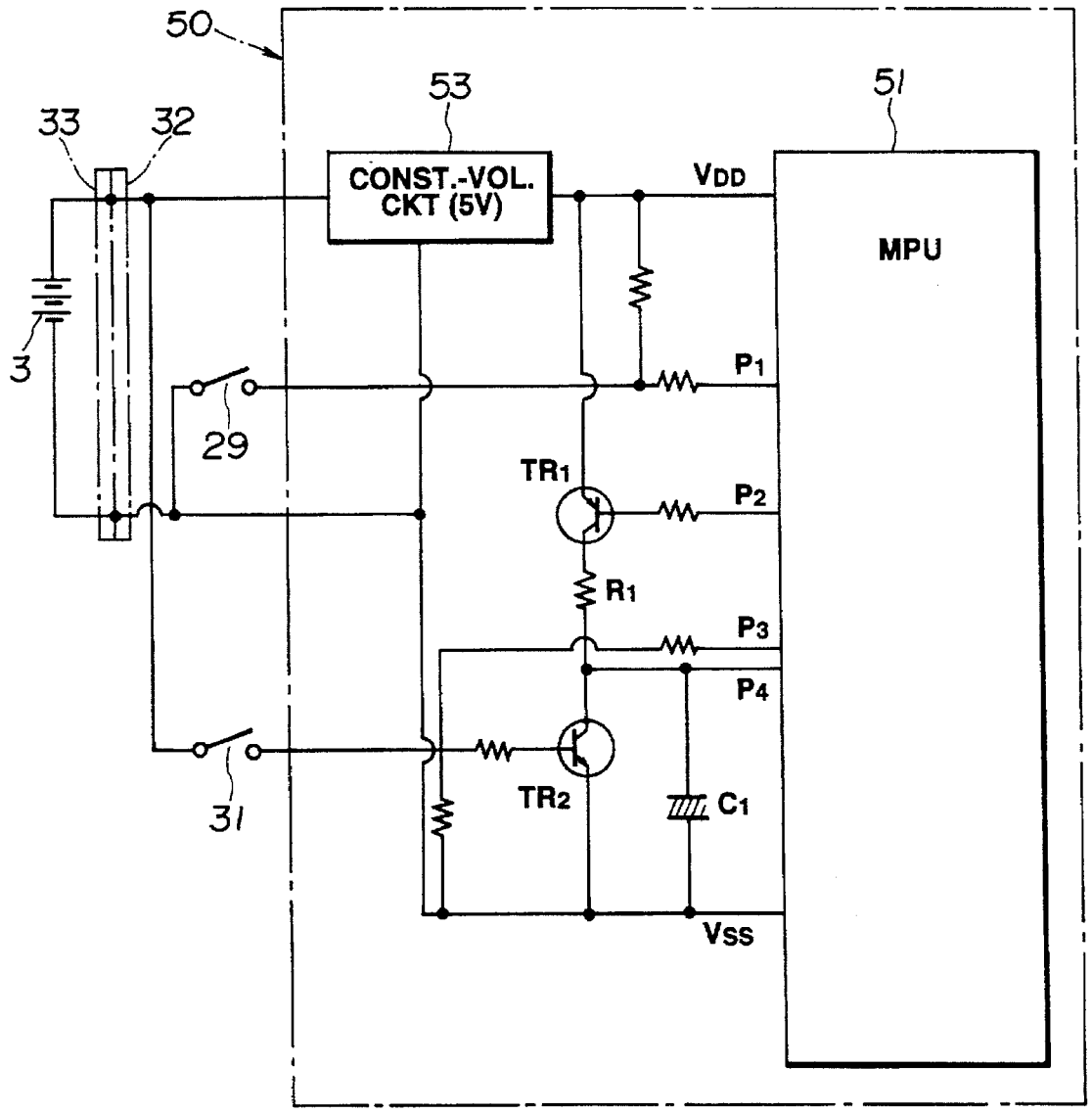
FIG. 15 is a circuit diagram illustrating an essential part of the controller of the system of the second embodiment.
Figure 16:
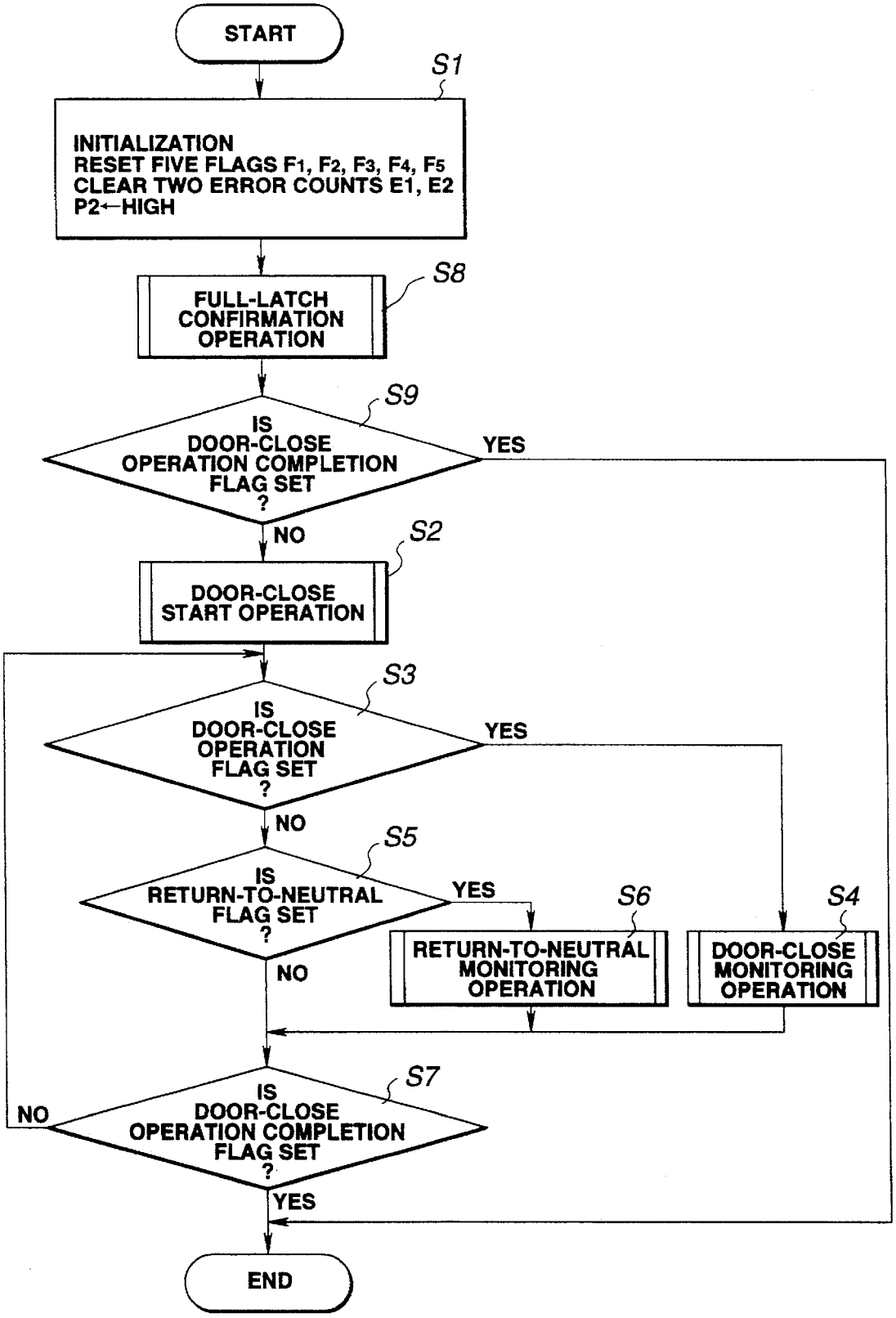
FIG. 16 is a flow chart illustrating a main routine of the system of the second embodiment.

Referring to FIGS. 15 through 18, there is shown the second embodiment of the door closing system. The basic construction of the system of the second embodiment as shown in FIGS. 15 to 18 is similar to that of the first embodiment as shown in FIGS. 1 to 14. Therefore, the same reference numerals and step numbers used in the first embodiment will be applied to the corresponding elements and steps used in the second embodiment, for the purpose of comparison between the first and second embodiments. The second embodiment is different from the first embodiment in that charging and discharging of a capacitor (an electrical condenser) C1 are utilized for the full-latch confirmation operation of the second embodiment. That is, as appreciated from the detection circuitry shown in FIG. 15, the full-latch confirmation operation of the system of the second embodiment is not achieved by directly detecting the switching operation of the half-latch detection switch 29, but by indirectly detecting an electric potential of one terminal P4 of the capacitor C1. FIG. 16 shows the main routine executed by the controller 50 of the system of the second embodiment. The main routine of the second embodiment (See FIG. 16) is different from that of the first embodiment (See FIG. 8), in that, the potential of a designated terminal P2 is set at a high level "H" in step S1 of FIG. 16, in addition to initialization as indicated in step S1 of FIG. 8. In comparison with the return-to-neutral monitoring operation of the first embodiment shown in FIG. 11, step S74A is newly added between steps S74 and S75 in the second embodiment shown in FIG. 17, in order to set the potential of the terminal P2 at a low level. The circuitry shown in FIG. 15 will be hereinbelow described briefly.

Figure 17:
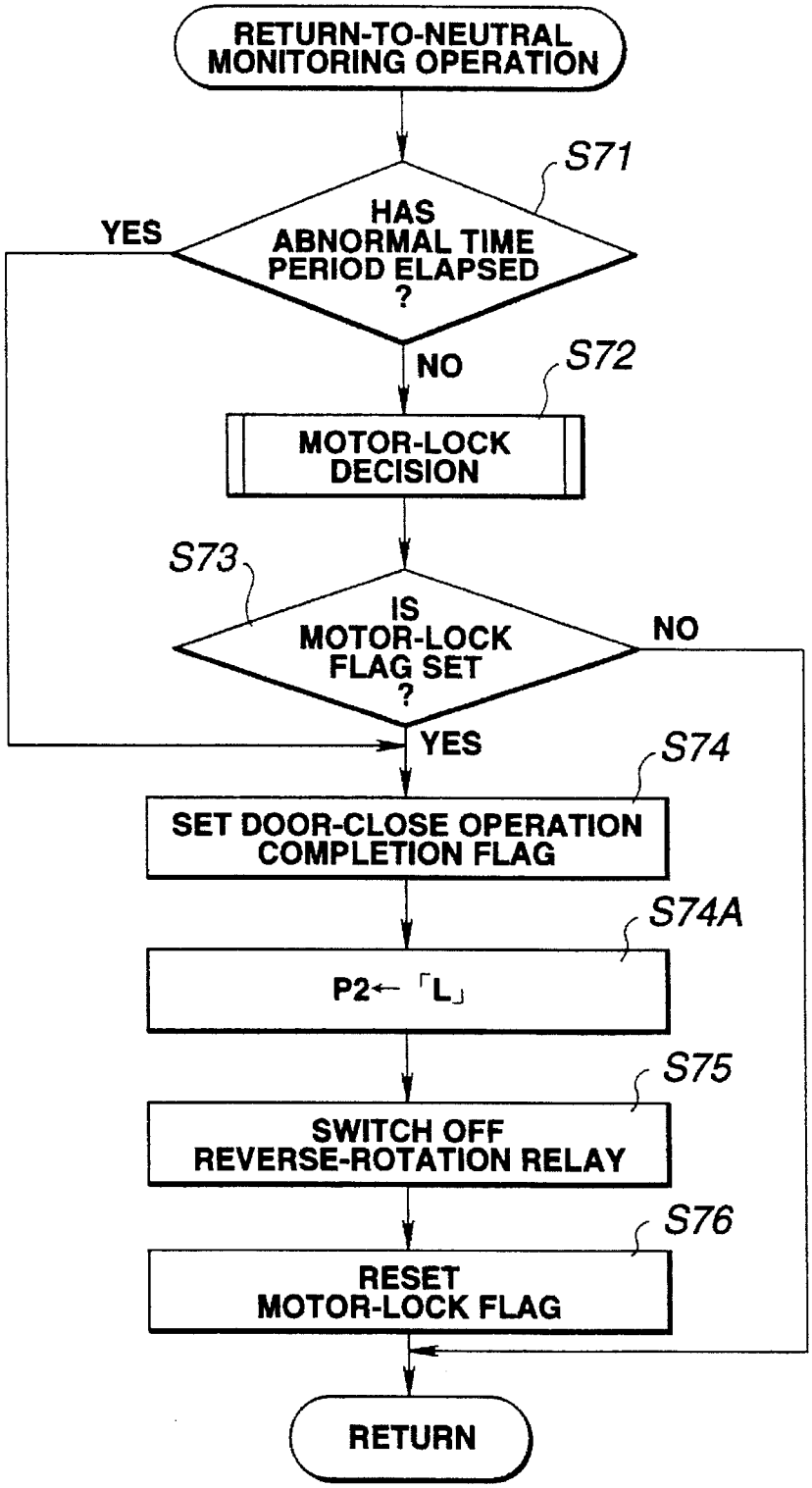
FIG. 17 is a flow chart explaining the return-to-neutral monitoring operation illustrated in step S6 of FIG. 16.
Figure 18:
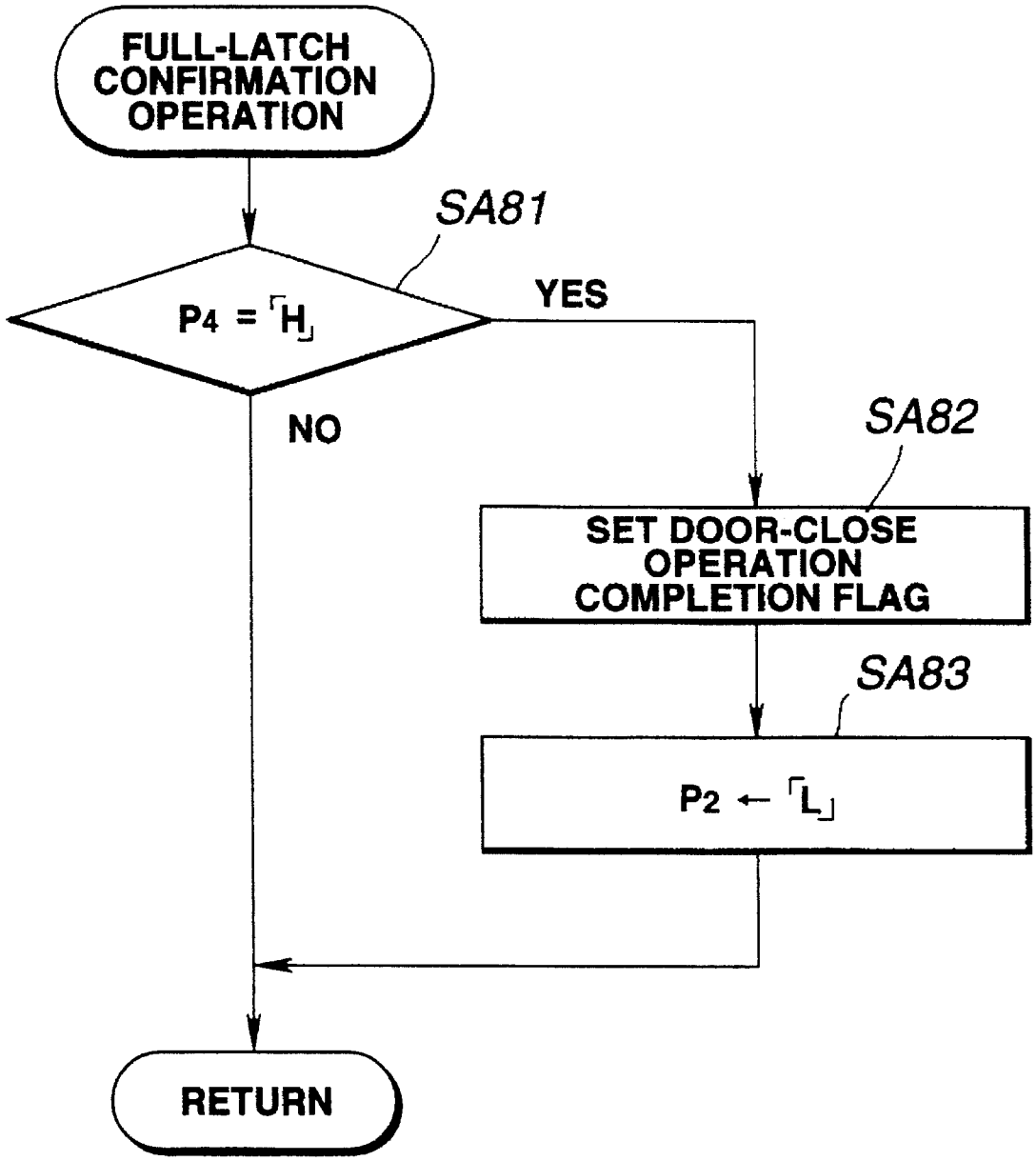
FIG. 18 is a flow chart explaining the fully-latched position monitoring operation illustrated in step S8 of FIG. 16.
Figure 19:
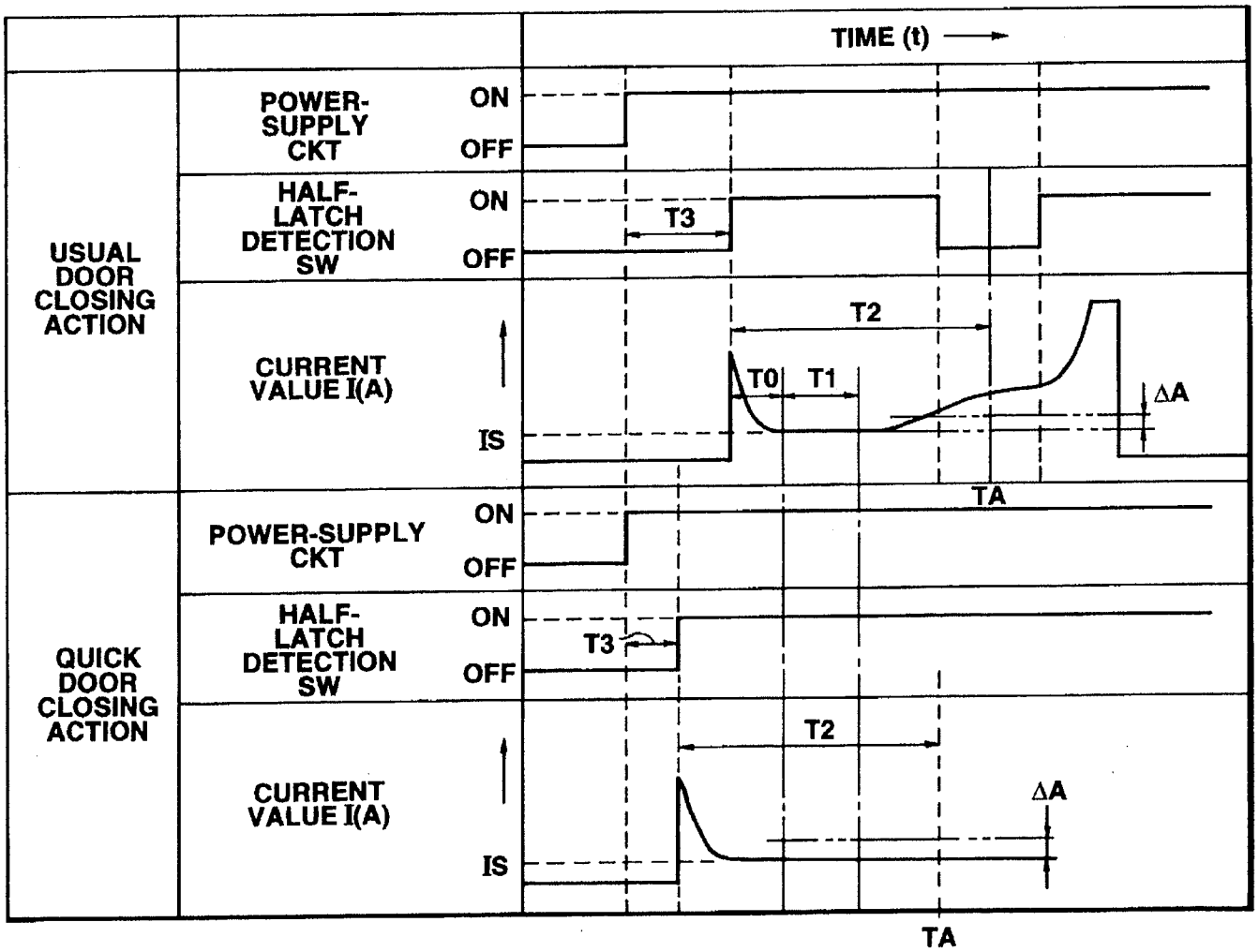
FIG. 19 is a time chart explaining a usual door closing action and a quick door closing action in the system of the third embodiment.

Referring to FIG. 15, the micro processor 51 has at least six terminals, namely a terminal VDD connected to the output terminal (voltage+5) of the constant-voltage circuit 53, a terminal P1 connected to the half-latch detection switch 29 via a resistor, a terminal P2 connected to a base of a pnp transistor TR1 via a resistor, a terminal P3 connected to a terminal Vss via resistors, a terminal P4 connected to a collector of a npn transistor TR2 and to one plate of the capacitor C1, and the terminal Vss connected to another plate of the capacitor C1 and to ground. The charging circuit for the capacitor C1 is established when the half-latch detection switch 29 is switched ON and thus the respective potentials of the terminals P1 and P2 become low and as a result the transistor TR1 is turned ON, and whereby the potential of the terminal P4 of the capacitor C1 becomes high. On the other hand, the discharging circuit for the capacitor C1 is established when the handle switch 31 is switched ON and thus the transistor TR2 is turned ON, and whereby the potential of the terminal P4 becomes reduced to a low level quickly. In the full-latch confirmation operation shown in FIG. 18, the controller decides that the latch member 12 has been rotated to the fully-latched position when the potential of the terminal P4 is high. That is, a test is made to determine whether or not the potential of the terminal P4 is high at step SA81. When the answer to step SA81 is affirmative, the door-close operation completion flag $F_3$ is set at step SA82, and then the potential of the terminal P2 is set at a low level at step SA83. Thereafter, the main program shown in FIG. 16 is recovered from the sub-routine shown in FIG. 18. Therefore, just after the return-to-neutral operation has been completed and the door-close operation completion flag $F_3$ has been set, as seen in FIG. 17, during the return-to-neutral monitoring operation the procedure flows from step S74 to step S74A in connection with the flow from step SA82 to step SA83 in FIG. 18. The terminal P4 is held at a high potential, while the terminal P2 is set at a low potential. With the terminal P4 held at a high potential in the door fully-closed state (in the fully-latched state), if the handle lever 30 is operated for the purpose of opening the sliding door 1, the handle switch 31 becomes switched ON, and as a result the potential of the terminal P4 becomes low. Under this condition, in the event that the door is closed again and the above-noted "normal connection" occurs, as seen in step S1 of FIG. 16, firstly, the potential of the terminal P2 is initialized to a "high level". Secondarily, the full-latch confirmation operation is made at step S8. Owing to the terminal P2 of a high potential, the transistor TR1 is not turned ON, and thus the charging circuit for the capacitor C1 is not yet established. In this case, the potential of the terminal P4 is low. Thus, the answer to step SA81 of FIG. 18 is negative and the door-close operation completion flag $F_3$ remains reset. As a result, in the main routine of FIG. 16, the procedure flows from step S9 to step S2, with the result that the door-close start operation is executed in accordance with the flow of FIG. 9. Thereafter, the door-close operation is executed in parallel with the door-close monitoring operation, and then the return-to-neutral operation is executed in parallel with the return-to-neutral monitoring operation. In contrast to the above, under the door completely-closed condition with the terminal P4 held at a high potential, if the above-noted "abnormal connection" or "re-connection" between the feeding portions 32 and 33 occurs, the potential of the terminal P2 is held low, since the half-latch detection switch 29 has already been switched ON simultaneously with establishment of the power-supply circuit for the controller 50, as appreciated from the right-hand side of FIG. 13. As a result, the charging circuit for the capacitor C1 is closed and then the potential of the terminal P4 is held high. Therefore, in step SA81 of FIG. 18, the controller decides that the latch member 12 is maintained at the fully-latched position, and thus setting the door-close operation completion flag to "1" at step SA82 and additionally setting the potential of the terminal P2 at a low level at step SA83 for the purpose of holding the potential of the terminal P4 high. In this manner, in the same manner as the system of the first embodiment, the system of the second embodiment can avoid ineffective auto closing action of the door closing device 20 in case of the "abnormal connection" or "re-connection".

Third embodiment

Referring now to FIGS. 19 to 23, there is shown the third embodiment of the door closing system. The system of the third embodiment is different from that of the first or second embodiment, in that a quick door-close decision sub-routine is provided in place of the full-latch confirmation operation as shown in FIG. 14 (the first embodiment) or as shown in FIG. 18 (the second embodiment), so as to determine as to whether or not the sliding door 1 is closing quickly. In order to accomplish the quick door-close decision, as appreciated from the door-close monitoring operation shown in FIG. 21, three decision diamonds SB23, SB24 and SB25 are provided between the decision box SB22 and the motor-lock decision sub-routine executed at step SB26, and as appreciated from step S1 of FIG. 20, newly provided in addition to the five flags $F_1$ to $F_5$ are three flags, namely a reference current value setting request flag $F_6$, a quick door-close decision request flag $F_7$ and a motor-lock decision request flag $F_8$. As detailed later, when the controller decides by way of the quick door-close decision sub-routine shown in FIG. 23 that the door 1 is closing quickly, the controller further determines that the latch member 12 has been rotated to the fully-latched position without requiring auto-closing action, and thereafter the motor 26 is timely stopped by means of the motor-drive limiting section 62. Hereinbelow described in detail is the door-close monitoring operation shown in FIG. 21 (the third embodiment), which is considerably different from the door-close monitoring operation shown in FIG. 10 (the first embodiment).

Firstly, in step SB21, a test is made to determine whether or not the above-noted predetermined abnormal time period has elapsed from the time when the motor normal-rotation relay has been switched ON. As appreciated from steps SB21, SB22 and SB23, on the assumption that the handle switch 31 is not yet switched ON within the predetermined abnormal time period, the procedure flows from step SB21 via step SB22 to step SB23, and thereafter the setting or resetting condition of each of the flags $F_6$, $F_7$ and $F_8$ is tested respectively at steps SB23, SB24 and SB25. When the answer to step SB21 is affirmative (YES), the controller decides that abnormality takes place during the door-close operation (during normal rotation of the motor), and then the procedure jumps to step SB28 and flows through steps SB29, SB30, SB31 and SB32 to step SB33. Steps SB28 to SB33 are identical to the respective steps S27 to S32 as shown in FIG. 10. In contrast, when the answer to step SB21 is negative (NO), step SB22 proceeds at which a test is made to determine whether the handle switch 31 is switched ON or OFF. When the answer to step S22 is affirmative (YES), i.e., when the handle switch 31 is switched ON, the controller decides that the sliding door 1 is in the door opening state, and then step SB28 enters. In this manner, in case of the affirmative answer to steps SB21 or SB22, the door-close operation is quickly shifted to the return-to-neutral operation.

In step SB23, a test is made to determine whether the reference current value setting request flag $F_6$ is set. When the flag $F_6$ is reset, step SB24 enters.

In step SB24, a test is made to determine whether the quick door-close decision request flag $F_7$ is set. When the flag $F_7$ is reset, step SB25 enters.

In step SB25, a test is made to determine whether the motor-lock decision request flag $F_8$ is set. When the flag $F_8$ is reset, step SB34 proceeds.

Figure 20:
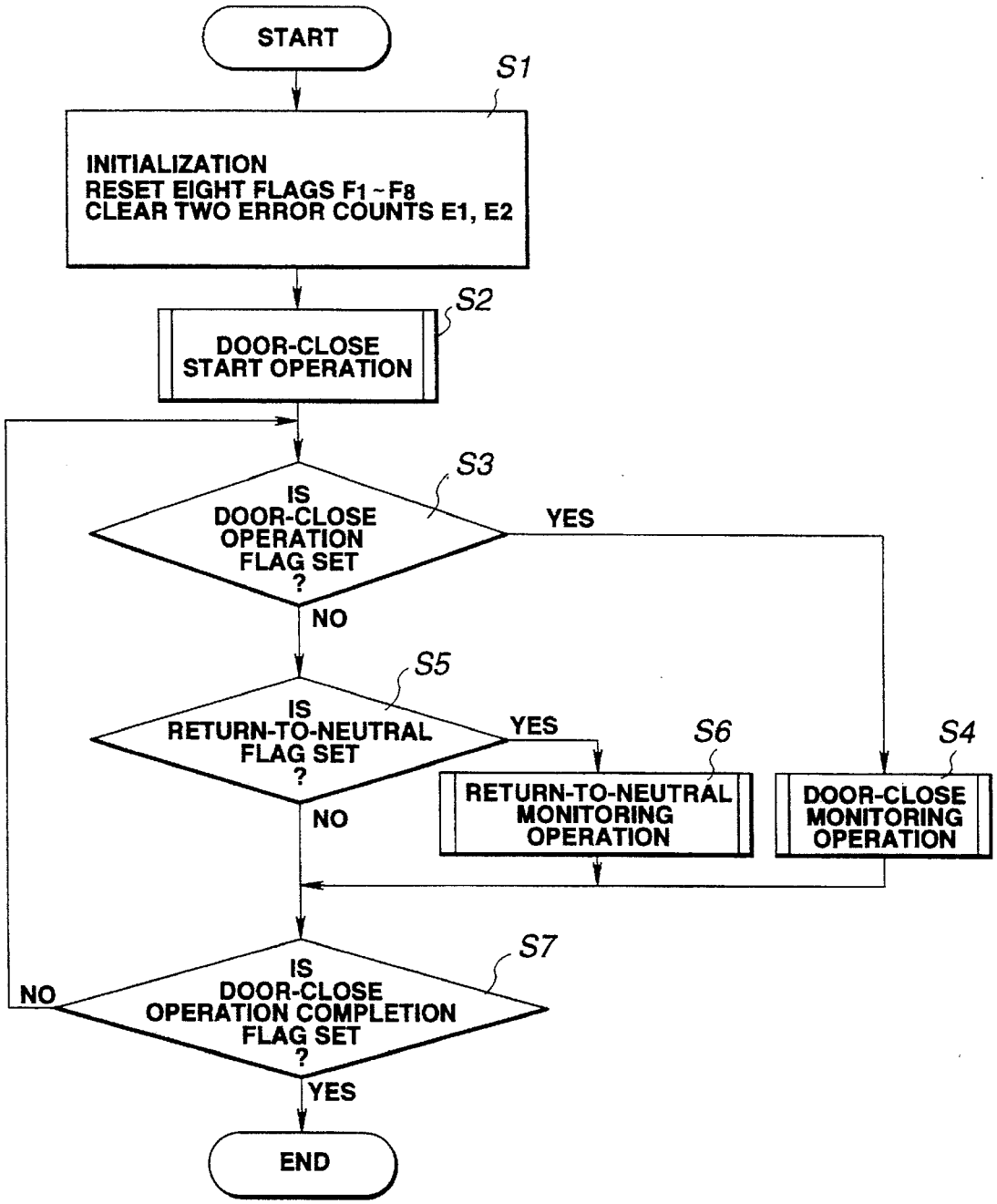
FIG. 20 is a flow chart explaining the operation of the system of the third embodiment.
Figure 21:
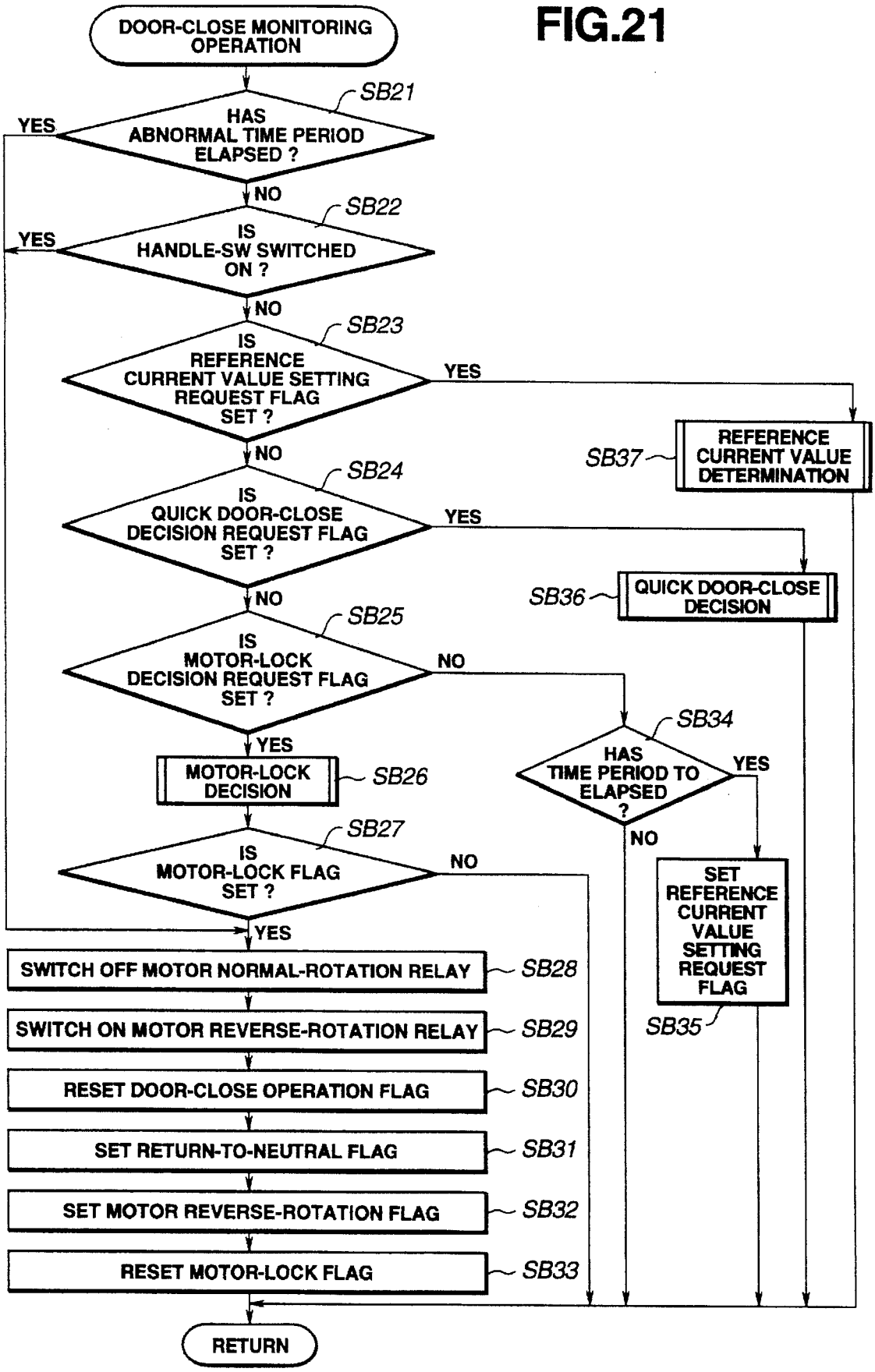
FIG. 21 is a flow chart explaining the door-close monitoring operation illustrated in step S4 of FIG. 20.

At the beginning of the door-close start operation, the reference current value setting request flag $F_6$, the quick door-close decision request flag $F_7$, and the motor-lock decision request flag $F_8$ all remain reset after initialization at step S1 of FIG. 20. Thus, at the beginning of the door-close monitoring operation shown in FIG. 21, after the flow from step SB21 via step SB22 to step SB23, the procedure will flow from step SB23 through steps SB24 and SB25 to step SB34.

In step SB34, a test is made to determine whether or not a predetermined time period $T_0$, required for stabilization of the drive current I of the motor 26, has elapsed from the time when the motor normal-rotation relay has been switched ON. The predetermined time period $T_0$ (See FIG. 19) is essentially equivalent to the previously-noted "drive-current stabilization time period t0". When the answer to step SB34 is affirmative (YES), i.e., in case that the drive-current stabilization time period $T_0$ has elapsed, step SB35 proceeds in which the reference current value setting request flag $F_6$ is set. In the event that the reference current value setting request flag $F_6$ has been set at step SB35, the procedure flows from step SB23 to step SB37 in which the reference current value determination procedure is executed in accordance with the flow chart of FIG. 22.

Figure 22:
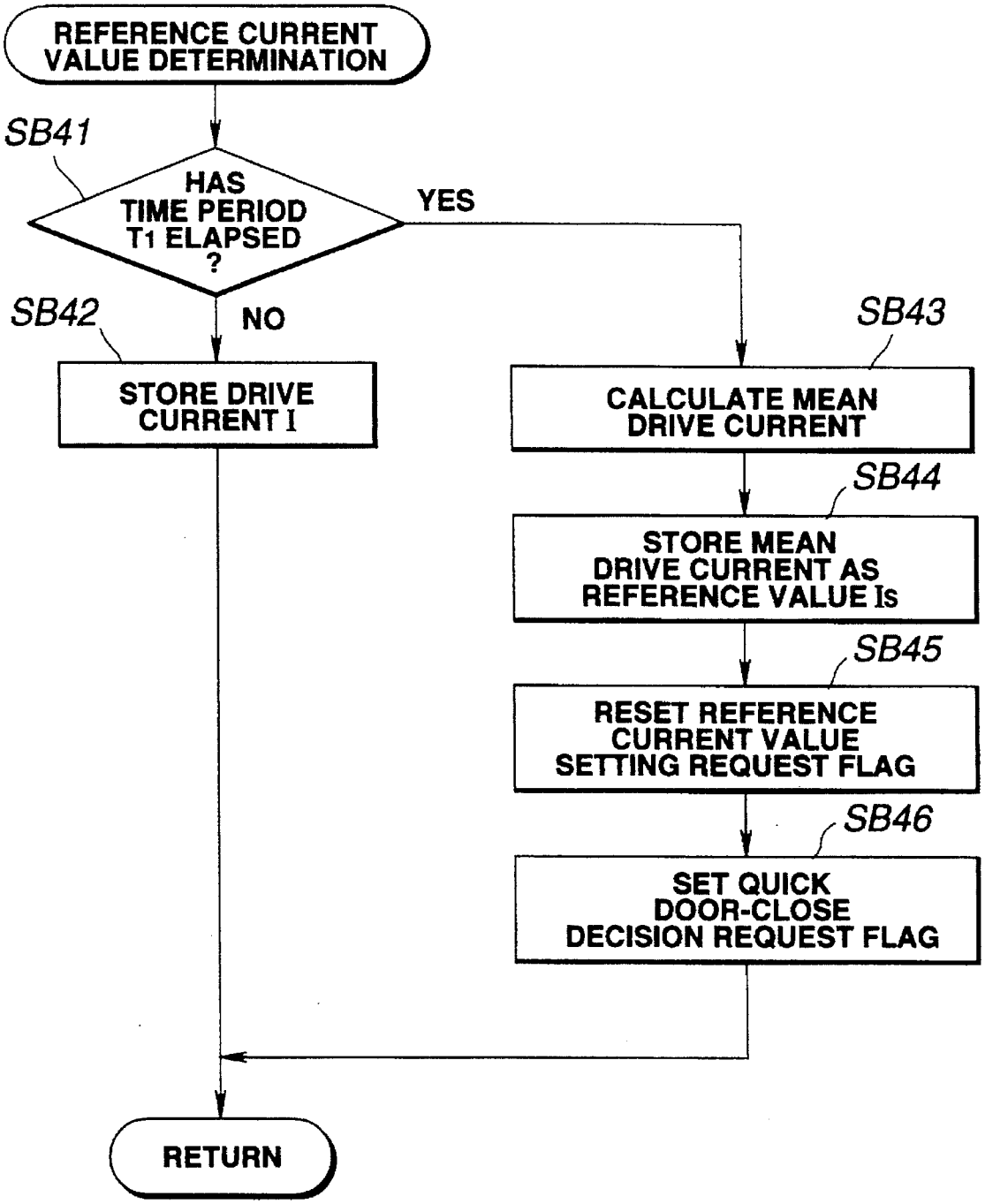
FIG. 22 is a flow chart explaining the procedure for determination of the reference current value illustrated in step SB37 of FIG. 21.

In the sub-routine shown in FIG. 22, in step SB41, a test is made to determine whether a predetermined time period $T_1$ (See FIG. 19) has further elapsed from the time when the drive-current stabilization time period $T_0$ has elapsed. When the answer to step SB41 is negative (NO), step SB42 proceeds in which the current value of the drive current of the motor 26 is stored in the memory of the micro processor. In this manner, the motor drive-current I is stored every sampling time interval until the predetermined time period $T_1$ has elapsed. In other words, the motor drive-current data I are sampled for the predetermined time period $T_1$. When the answer to step SB41 is affirmative, i.e., as soon as the predetermined time period $T_1$ has elapsed, a mean value of the sampled drive-current data is calculated at step SB43, and the calculated mean value is memorized as a reference current value Is at step SB44, and simultaneously the reference current value setting request flag $F_6$ is reset at step SB45, and finally the quick door-close decision request flag $F_7$ is set at step SB46. After setting the quick door-close decision request flag $F_7$ at step SB46, the procedure flows from step SB24 to step SB36 in which the quick door-close decision procedure is executed in accordance with the flow chart of FIG. 23.

Figure 23:
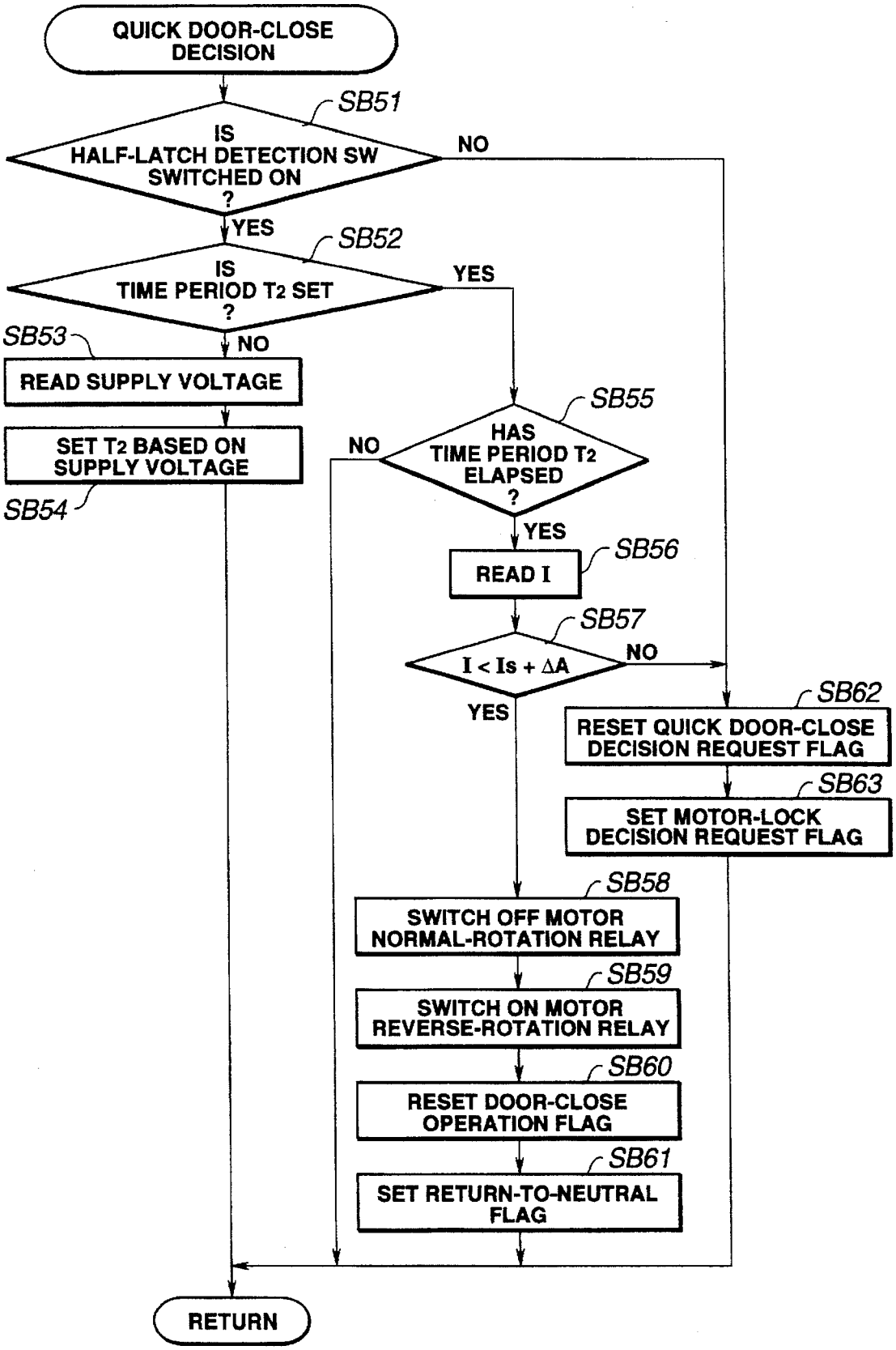
FIG. 23 is a flow chart explaining the procedure for decision of quick door-close action of the system of the third embodiment.

In the sub-routine shown in FIG. 23, in step SB51, a test is made to determine whether or not the half-latch detection switch 29 is switched ON. When the answer to step SB51 is affirmative (YES), step SB52 proceeds in which a test is made to determine whether or not a power-supply voltage dependent time period $T_2$ is set. When the supply voltage dependent time period $T_2$ is not yet set, the power-supply voltage is read at step SB53, and the supply voltage dependent time period $T_2$ is set depending on the power-supply voltage at step SB54. The characteristic curve indicative of the relationship between the power-supply voltage and time period $T_2$ is experimentally determined by the inventors of the present invention and pre-stored in the memory of the MPU in the form of a data map. Actually, the supply voltage dependent time period $T_2$ is required to set a timing $T_A$ (See FIG. 19) for the quick door-close decision. As is generally known, the higher the supply voltage, the faster the door closing action. In consideration of changes in the rotational speed of the motor 26 based on the supply voltage, the above-noted supply voltage dependent time period $T_2$ is so designed to decrease, as the supply voltage becomes higher. Thus, the timing $T_A$ for the quick door-close decision can be suitably advanced. Such advancement of the timing $T_A$ is important to more precisely give the quick door-close decision. As soon as the time period $T_2$ is properly set at step SB54, the procedure flows from step SB52 to step SB55 in which a test is made to determine whether or not the time period $T_2$ has elapsed. When the time period $T_2$ has elapsed, step 56 proceeds in which the current value of the motor drive-current I is read just at the timing $T_A$ for the quick door-close decision. Thereafter, step SB57 enters in which the current value of the motor drive-current I is compared with the sum ($Is+\Delta A$) of the reference current value Is and a preset margin $\Delta A$. The preset margin $\Delta A$ is so designed that the motor drive-current I is greater than or equal to the sum ($Is+\Delta A$) during relatively great load running of the motor 26 owing to shift to the fully-latched position of the latch member 12 that is to say in case of the usual (comparatively slow) door closing action as seen in the upper half of FIG. 19, and that the motor drive-current I is less than the sum ($Is+\Delta A$) during almost no-load running of the motor 26 owing to quick door-close action as seen in the lower half of FIG. 19.

In case of $I<Is+\Delta A$ at step SB57, four steps SB58, SB59, SB60 and SB61 proceed in that order. In step SB58, the motor normal-rotation relay is switched OFF. In step SB59, the motor reverse-rotation relay is switched ON. In step SB60, the door-close operation flag $F_1$ is reset. In step SB61, the return-to-neutral flag $F_2$ is set. That is, in case of $I<Is+\Delta A$, the controller decides that the quick door closing action is made, and produces a quick door-close decision instruction. Based on the quick door-close decision instruction, steps SB58 to SB61 are executed with the result that the door-close operation terminates and in lieu thereof the return-to-neutral operation begins. On the other hand, in case of $I\geq Is+\Delta A$ at step SB57, the controller decides that the usual door closing action is made, and thus the quick door-close decision request flag $F_7$ is reset at SB62 and also the motor-lock decision request flag $F_8$ is set at step SB63. Thereafter, the procedure flows from step SB25 to step SB26 in which the motor-lock decision operation shown in FIG. 12 is executed, as previously explained. When the latch member 12 reaches the fully-latched position and thus the motor-lock flag $F_4$ is set at step S63 of FIG. 12, the procedure flows from step SB26 through step SB27 to step SB28, and then flows through steps SB29 to SB32 to step SB33, and as a result the return-to-neutral monitoring operation is executed in synchronization with initiation of the return-to-neutral operation.

Fourth embodiment

Figure 24:
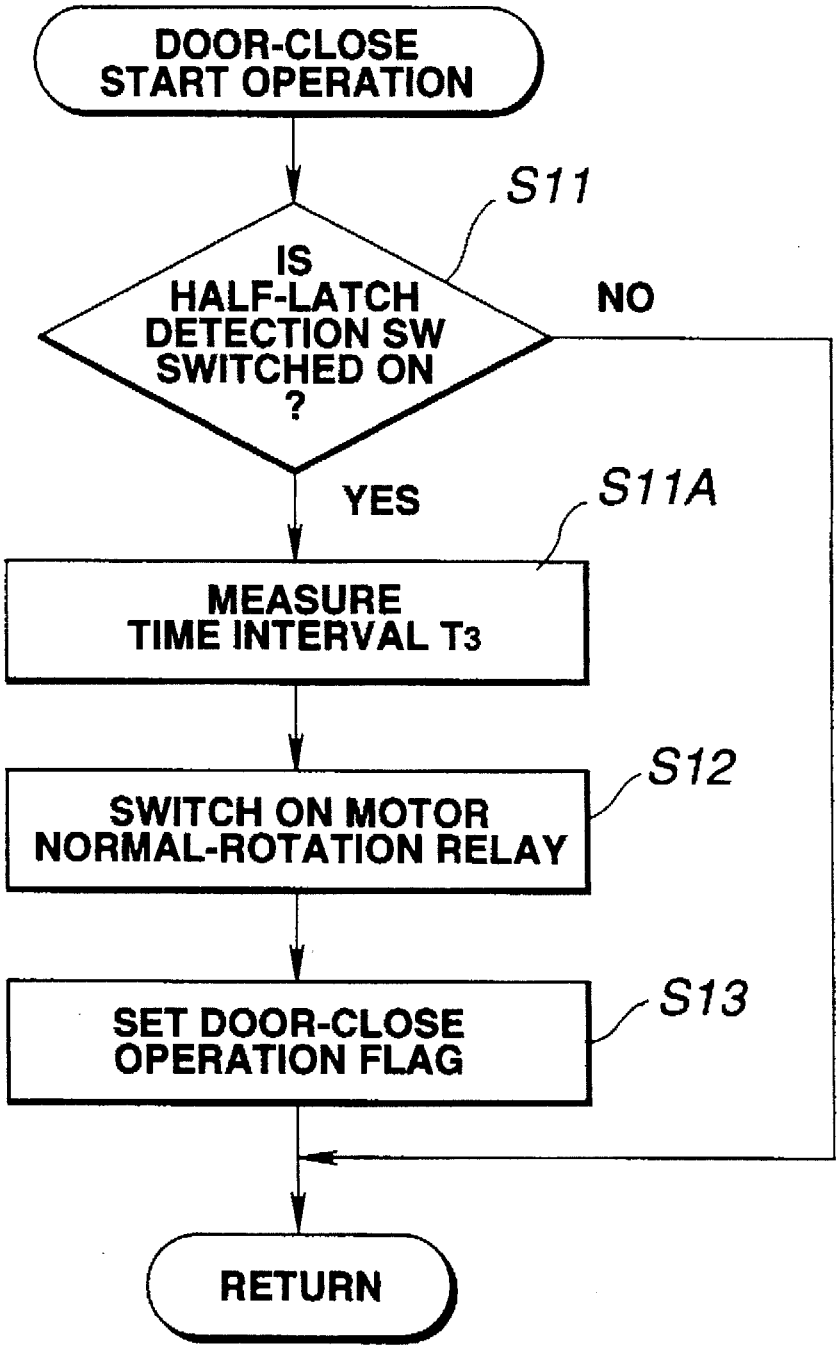
FIG. 24 is a flow chart explaining the door-close starting operation of the system of the fourth embodiment.
Figure 25:
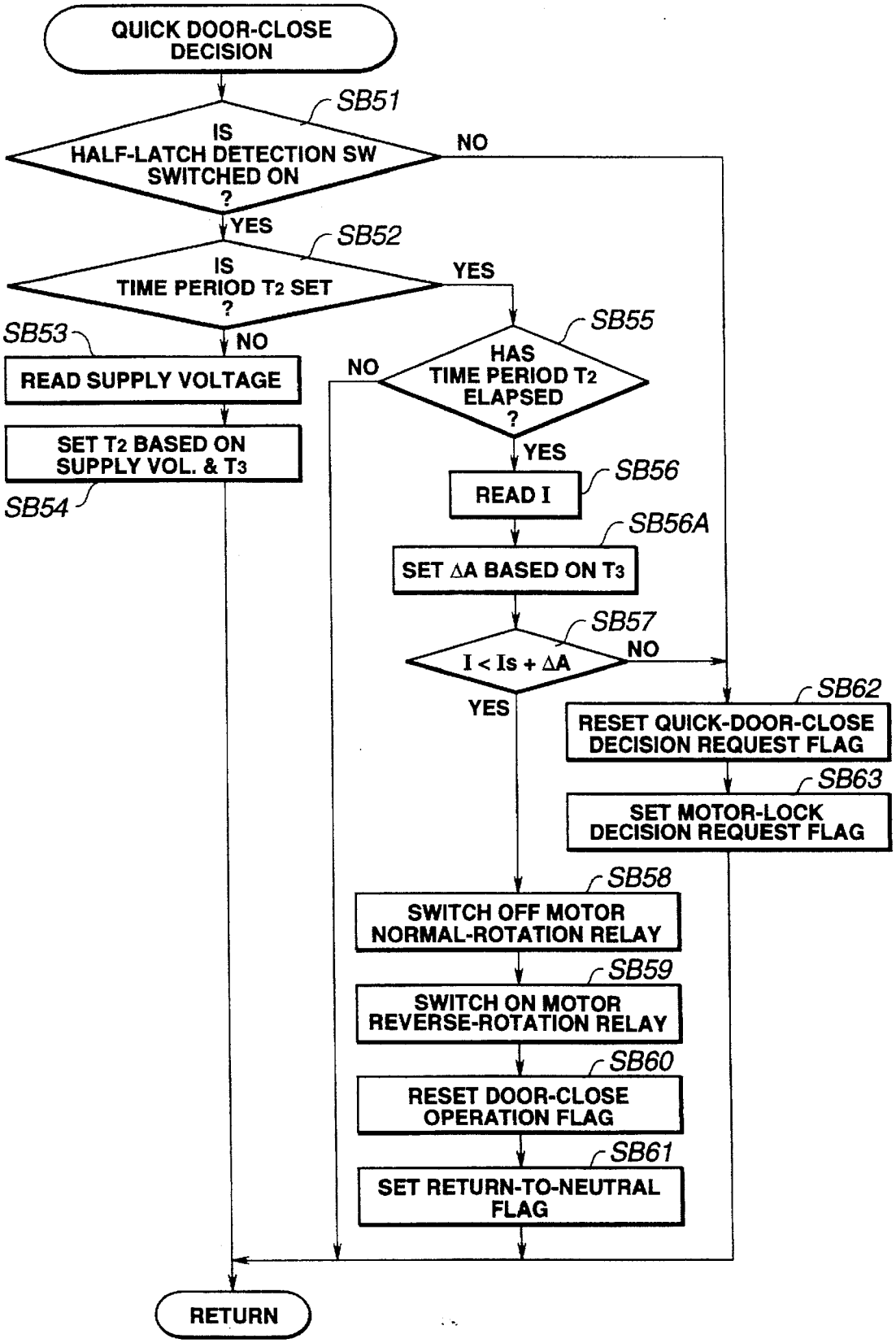
FIG. 25 is a flow chart explaining the procedure for decision of quick door-close action of the system of the fourth embodiment.

Referring now to FIGS. 24 and 25, there is shown the fourth embodiment of the door closing system. The system of the fourth embodiment is different from that of the third embodiment, in that a time interval $T_3$ (See FIG. 19) between the time when the power-supply circuit is closed (the power-source is turned ON) and the time when the half-latch detection switch 29 is switched ON is further considered, so as to precisely set the above-noted supply voltage dependent time period $T_2$ in consideration of the time interval $T_3$ as well as the power-supply voltage, and to variably set the above-noted preset margin $\Delta A$ depending upon the time interval $T_3$. For the above reason set forth above, as compared with the door-close start operation in S2 of FIG. 20 (identical to the door-close start operation shown in FIG. 9, step 11A is newly added as a necessary condition of the door-close start operation in the system of the fourth embodiment, as seen in FIG. 24.

Referring to FIG. 24, in step S11, as soon as the half-latch detection switch 29 becomes switched ON, the time interval $T_3$ is measured at step S11A. Thereafter, the motor normal-rotation relay of the relay control section 54 is turned ON at step S12 and then the door-close operation flag $F_1$ is set at step S13.

As appreciated from the flow chart shown in FIG. 25, the quick door-close decision of the system of the fourth embodiment is different from that of the third embodiment. As clearly seen in FIG. 25, the supply voltage dependent time period $T_2$ is set on the basis of both the supply voltage and the time interval $T_3$ at step SB54. As appreciated, the faster the door closing speed, the shorter the time interval $T_3$. With a relatively shorter time interval $T_3$ measured, the supply voltage dependent time period $T_2$ is set at a shorter period to advance the timing $T_A$ for the quick door-close decision. With a relatively longer time interval $T_3$ measured, the supply voltage dependent time period $T_2$ is set at a longer period to retard the timing $T_A$. Additionally, step SB56A is newly added between steps SB56 and SB57, to properly set the margin $\Delta A$ depending on the time interval $T_3$. This optimizes a sensitivity of the quick door-close decision. In more detail, in case that the time interval $T_3$ is shorter, the margin $\Delta A$ is set at a smaller value, and thus enhancing the sensitivity of the quick door-close decision. In case that the time interval $T_3$ is longer, the margin $\Delta A$ is set at a greater value, and thus lowering the sensitivity of the quick door-close decision. Accordingly, the system of the fourth embodiment is superior to the system of the third embodiment.

As will be appreciated from the above, the door closing system made according to the present invention can recognize, confirm and precisely decide that the latch member employed in the door lock device 10 is maintained at its fully-latched position. Also, the system can recognize, confirm and more precisely decide that, during quick door-close action, the latch member may be rotated to the fully-latched position with great momentum rather than auto-closing action of the door closing device 20. In the presence of an output of the decision instruction indicative of a quick door closing action or of a fully-latched state, ineffective auto-closing operation of the door closing device is limited. This prevents wasteful power consumption and an uncomfortable feel of the operator, during door closing operation.

While the foregoing is a description of the preferred embodiments for carrying out the invention, it will be understood that the invention is not limited to the particular embodiments shown and described herein, but that various changes and modifications may be made without departing from the scope or spirit of this invention as defined by the following claims.

What is claimed is:

1. A powered vehicle door closing system for producing an auto-closing action to automatically move a latch member from a half-latched position to a fully-latched position, said system comprising:

a reversible motor mechanically linked through a linkage, having a neutral position, to said latch member, for powering a final, low-displacement/high-force movement of a vehicle door; and control means for controlling said reversible motor so that said reversible motor is driven in its normal-rotation direction for rotational movement of said latch member toward said fully-latched position when said half-latched position is reached during manual door closing operation, and so that said reversible motor is driven in its reverse-rotation direction for movement of said linkage toward said neutral position of said linkage when said fully-latched position is reached during auto-closing action, and so that said reversible motor is stopped when said linkage reaches said neutral position;

said control means including confirmation means for confirming that said latch member is maintained at said fully-latched position and limit means for limiting re-activation of said reversible motor when said confirmation means decides that said latch member has already been shifted to and maintained at said fully-latched position.

2. A powered vehicle door closing system as set forth in claim 1, wherein said confirmation means comprises a partly-opened position detection switch for detecting a predetermined partly-opened position of said vehicle door via which partly-opened position said latch member reaches said half-latched position during door closing, a half-latch detection switch for detecting that said latch member reaches said half-latched position, means for measuring a time interval from a time when said partly-opened position detection switch detects that said predetermined partly-opened position is reached to a time when said half-latch detection switch detects that said half-latched position is reached, and means for deciding that said latch member has already been shifted to and maintained at said fully-latched position when said time interval is within a predetermined short time interval.

3. A powered vehicle door closing system as set forth in claim 2, wherein said partly-opened position detection switch comprises a pair of electric power-feeding portions for establishing a power-supply circuit for said control means when said vehicle door reaches said predetermined partly-opened position.

4. A powered vehicle door closing system as set forth in claim 1, wherein said confirmation means comprises a partly-opened position detection switch for detecting a predetermined partly-opened position of said vehicle door via which partly-opened position said latch member reaches said half-latched position during door closing, a half-latch detection switch for detecting that said latch member reaches said half-latched position, first measurement means for measuring a first short elapsed time from a time when said partly-opened position detection switch detects that said predetermined partly-opened position is reached, second measurement means for measuring a second short elapsed time from a time when said partly-opened position detection switch detects that said predetermined partly-opened position is reached, and means for deciding that said latch member has already been shifted to and maintained at said fully-latched position when said half-latch detection switch is switched ON within a time interval defined between said first and second short elapsed times.

5. A powered vehicle door closing system as set forth in claim 1, wherein said confirmation means comprises a pair of electric power-feeding portions for establishing a power-supply circuit for said control means when said vehicle door reaches said predetermined partly-opened position, means for monitoring a return-to-neutral action of said linkage to said neutral position and for setting a flag representing that said neutral position is reached after said power-supply circuit has been established, and means for deciding that said latch member has been established, and means for deciding that said latch member has already been shifted to and maintained at said fully-latched position when said flag is set.

6. A powered vehicle door closing system as set forth in claim 1, wherein said confirmation means comprises means for detecting a load applied to said reversible motor when said latch member moves from said half-latched position to said fully-latched position, and decision means for deciding that said latch member has already been shifted to and maintained at said fully-latched position when said load is less than a predetermined threshold.

7. A powered vehicle door closing system as set forth in claim 6, wherein said means for detecting said load comprises current detection means for detecting a drive current flowing through said reversible motor, and said decision means deciding that said latch member has already been shifted to and maintained at said fully-latched position when said drive current is less than a predetermined comparison current value.

8. A powered vehicle door closing system as set forth in claim 7, which further comprises means for calculating said comparison current value by adding a present margin to a mean value of said drive current sampled for a predetermined time period from a time when a predetermined time period for stabilization of said drive current has elapsed.

9. A powered vehicle door closing system as set forth in claim 8, wherein said confirmation means comprises a partly-opened position detection switch for detecting a predetermined partly-opened position of said vehicle door via which partly-opened position said latch member reaches said half-latched position during door closing, a half-latch detection switch for detecting that said latch member reaches said half-latched position, means for measuring a time interval from a time when said partly-opened position detection switch detects that said predetermined partly-opened position is reached to a time when said half-latch detection switch detects that said half-latched position is reached, and means for setting said preset margin depending upon said time interval.

10. A powered vehicle door closing system as set forth in claim 9, wherein said preset margin is reduced in accordance with a decrease in said time interval.

* * * * *